US008126363B2

(12) United States Patent
Fujita et al.

(10) Patent No.: US 8,126,363 B2
(45) Date of Patent: Feb. 28, 2012

(54) BELT FEED APPARATUS AND IMAGE FORMING APPARATUS USING THE SAME

(75) Inventors: Naohisa Fujita, Saitama (JP); Takuya Kobayashi, Saitama (JP); Masaki Suto, Saitama (JP); Toshihiro Kanematsu, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 714 days.

(21) Appl. No.: 12/249,394

(22) Filed: Oct. 10, 2008

(65) Prior Publication Data

US 2009/0184464 A1 Jul. 23, 2009

(30) Foreign Application Priority Data

Jan. 18, 2008 (JP) ..... P2008-008967

(51) Int. Cl.
*G03G 15/08* (2006.01)

(52) U.S. Cl. ..... 399/121

(58) Field of Classification Search ..... 198/811, 198/837; 399/121, 302, 308, 312
See application file for complete search history.

(56) References Cited

U.S. PATENT DOCUMENTS

2007/0253754 A1 11/2007 Kobayashi et al.

FOREIGN PATENT DOCUMENTS

| | | |
|---|---|---|
| JP | 06-003886 | 1/1994 |
| JP | 7-036349 | 2/1995 |
| JP | 10-240026 | 9/1998 |
| JP | 11-212387 | 8/1999 |
| JP | 2000-025975 | 1/2000 |
| JP | 2001-305877 | 11/2001 |
| JP | 2002-174966 | 6/2002 |

*Primary Examiner* — David Gray
*Assistant Examiner* — Gregory H Curran
(74) *Attorney, Agent, or Firm* — Morgan, Lewis & Bockius LLP

(57) ABSTRACT

A belt feed apparatus, includes: an endless belt member; a belt back surface member including a close portion disposed close to the endless belt member to such a degree that, when the endless belt member stands stationary, the close portion is prevented from touching the endless belt member, and while the endless belt member is circulating, the close portion can be contacted with the endless belt member irregularly; and a non-sticking portion that includes a non-sucking surface contactable with the endless belt member to prevent the endless belt member from being electrostatically sucked to the close portion, the non-sucking surface being provided in an entire portion or part of a surface of the close portion opposed to the endless belt member, and due to the existence of the non-sucking surface, the non-sticking portion being able to prevent the endless belt member from sticking to the close portion.

11 Claims, 17 Drawing Sheets c-c SECTION

FIG. 16

| | MEASURED VALUES (kV) | MEDIAN VALUES (kV) |
|---|---|---|
| POLYURETHANE | −6 ~ +8 | +1 |
| POLYESTER | +2 ~ +12 | +7 |
| POLYPROPYLENE | +4 ~ +10 | +7 |

FIG. 17

| NO. | Ra (μm) | Rz (μm) | MEASURED VALUES (kV) | MEDIAN VALUES (kV) | CIRCULATION PERFORMANCE OF BELT MEMBER |
|---|---|---|---|---|---|
| 1 | 1.7 | 7.0 | +8 ~ +14 | +11 | × |
| 2 | 3.5 | 15.0 | +2 ~ +15 | +8.5 | × |
| 3 | 0.9 | 3.5 | +9 ~ >+20 | – | × |
| 4 | 8.0 | 33.5 | +3 ~ +8 | +5.5 | ○ |
| 5 | 5.4 | 29.5 | +2 ~ +10 | +6 | ○ |
| REFERENCE | POLYURETHANE | | -6 ~ +8 | +1 | ○ |

BELT FEED APPARATUS AND IMAGE FORMING APPARATUS USING THE SAME

CROSS-REFERENCE TO RELATED APPLICATION

This application is based on and claims priority under 35 USC 119 from Japanese Patent Application No. 2008-008967 filed Jan. 18, 2008.

BACKGROUND

1. Technical Field

The present invention relates to a belt feed apparatus and an image forming apparatus using the belt feed apparatus.

2. Related Art

In an image forming apparatus of an electro photographic type or a similar type, there is incorporated a belt feed apparatus of a type using a feed belt for electrostatically sucking and feeding a recording member or an intermediate transfer belt for temporarily holding and feeding a toner image. In this type of belt feed apparatus, on the back surface side of a belt member such as the feed belt and intermediate transfer belt, there is provided a belt back surface member serving as a support member for supporting a member such as a transfer member. Especially when reducing the size of the apparatus, the belt back surface member is disposed such that a portion thereof is situated close to the inner peripheral surface of the belt member.

SUMMARY

According to an aspect of the invention, there is provided a belt feed apparatus, including:

an endless belt member that is carried on a plurality of carry members and capable of circulatory motion thereon;

a belt back surface member that is disposed on a back surface side of the endless belt member, the belt back surface member including a close portion disposed close to the endless belt member to such a degree that, when the endless belt member stands stationary, the close portion is prevented from touching the endless belt member, and while the endless belt member is circulating, the close portion can be contacted with the endless belt member irregularly; and a non-sticking portion that includes a non-sucking surface contactable with the endless belt member to prevent the endless belt member from being electrostatically sucked to the close portion, the non-sucking surface being provided in an entire portion or part of a surface of the close portion opposed to the endless belt member, and due to the existence of the non-sucking surface, the non-sticking portion being able to prevent the endless belt member from sticking to the close portion.

BRIEF DESCRIPTION OF THE DRAWINGS

Exemplary embodiments of the present invention will be described in detail based on the following figures, wherein:

FIG. 10A is an explanatory view of the circulation operation of a belt in the exemplary embodiment 2, while FIG. 10B shows a case in which a belt member does not wave and FIG. 10C shows a case in which the belt member waves;

FIG. 16 is a table to show the results of Example 1; and

FIG. 17 is a table to show the results of Example 2.

DETAILED DESCRIPTION

Firstly, description will be given roughly of an embodiment model to which the invention is applied.

Summary of the Embodiment Model

Figure 1A:
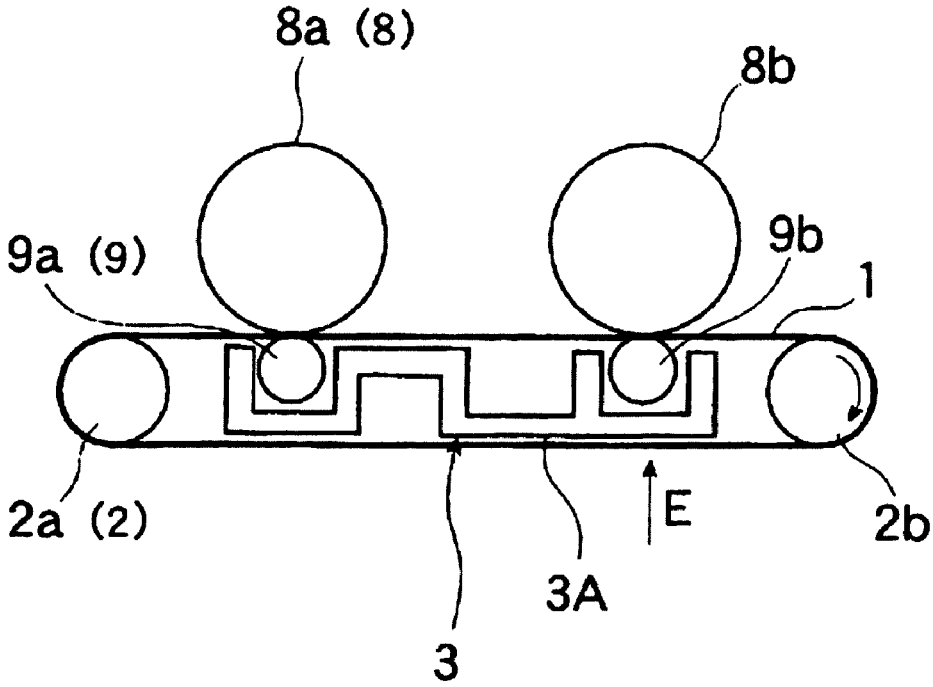
FIG. 1A is an explanatory view of the outline of an image forming apparatus to which a belt feed apparatus according to a first exemplary embodiment of the present embodiment model of the invention is applied.
Figure 1B:
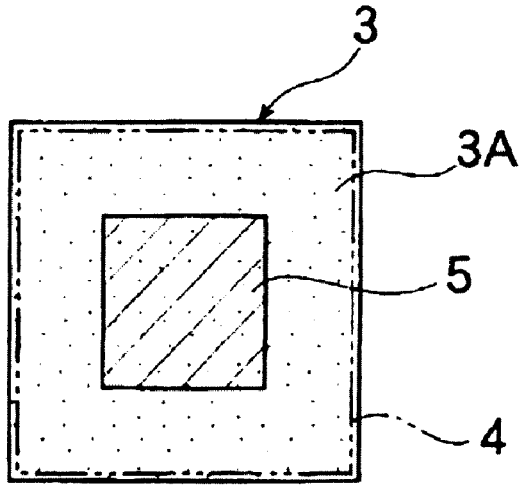
FIG. 1B is a partially enlarged view of a non-sticking portion formed in a belt back surface member.

FIGS. 1A and 1B show the outline of an image forming apparatus to which there is applied a belt feed apparatus according to a first exemplary embodiment of the embodiment model for embodying the invention. In FIGS. 1A and 1B, according to the structure of an image forming apparatus according to the present embodiment model, an image hold member 8 (in the present embodiment, two hold members 8*a* and 8*b*) is disposed such that it is opposed to the surface side of a belt member 1 used in the present belt feed apparatus, and, on the back surface side of the belt member 1, there is disposed a transfer member 9 (in the present embodiment, two transfer members 9*a* and 9*b*) for transferring a toner image on the image hold member 8 at a position opposed to the image hold member 8.

A typical belt feed apparatus applied to the above-structured image forming apparatus, as shown in FIGS. 1A and 1B, includes: an endless belt member 1 carried on a plurality of carry members 2 (2*a*, 2*b*) and capable of circulating thereon; a belt back surface member 3 disposed on the back surface side of the belt member 1 and including a close portion 3A disposed so close to the belt member 1 that it is prevented from touching the belt member 1 when the belt member 1 stands stationary and can be irregularly contacted with the belt member 1 while it is circulating; and, a non-sticking portion 4 disposed on the back surface side of the belt member 1 and including a non-sucking surface 5 formed in the entire or partial portion of the close portion 3A of the belt back surfaced member 3 opposed to the belt member 1 and contactable with the belt member 1 to thereby prevent the belt member 1 from being electrostatically sucked to the close portion 3A, while, owing to the existence of the non-sucking surface 5, the non-sticking portion 4 is able to prevent the belt member 1 from sticking to the close portion 3A. Here, FIG. 1A shows the schematic structure of the image forming apparatus and FIG. 1B is a partially enlarged view of the surface of the close portion 3A when the close portion 3A shown in FIG. 1A is viewed from the arrow mark E direction.

Here, the belt back surface member 3 is disposed on the back surface side of the belt member 1, for example, in such a manner that it supports a built-in member such as the transfer member 9. Thus, from the viewpoint of shape stability, mass production and the like, preferably, the belt back surface member 3 may be made of synthetic resin. Also, the term "close position that allows the close portion 3A to touch the belt member 1 irregularly" means that the belt back surface member 3 includes the close portion 3A disposed at such distance that allows the belt member 1 to touch the belt back surface member 3 when the circulating belt member 1 flutters or is pressed toward the back surface side thereof.

Further, the belt member 1 may be a member which is carried on a plurality of carry members 2 and is able to circulate thereon. Specifically, it may be a feed belt which holds and feeds a recording member, or it may be an intermediate transfer member which holds toner images temporarily and transfers them to a recording member all at once.

And, as the non-sticking portion 4, in order to prevent the belt member 1 and close portion 3A from sticking to each other, there may be used a portion which include the non-sucking surface 5. As the non-sucking surface 5 is used to prevent the belt member 1 from sticking to the close portion 3A of the belt back surface member 3. Thus, as the non-sucking surface 5, for example, in order to be able to reduce an electrostatic sucking force with respect to the belt member 1 while circulating, for example, there may be stuck a sheet which provides a small amount of frictional electrification with respect to the belt member 1, or the surface of the belt back surface member 3 itself may be formed such that the contact area thereof with the belt member 1 is reduced so as to be able to reduce the electrostatic sucking force.

In order to reduce an electrostatic sticking force depending on the amount of frictional electrification generated when the belt member 1 rubs against the non-sticking portion 4, the non-sticking portion 4 may preferably structured in the following manner.

That is, the non-sticking portion 4 may be formed integrally with or separately from the close portion 3A of the belt back surface member 3 and, in the range thereof where it functions as the non-sucking surface 5, the non-sticking portion 4 may be made of such material that can reduce the frictional electrification amount generated between the belt member 1 and the non-sucking surface 5. This structure can control the frictional electrification amount itself generated down to a low level. Specifically, when the belt member 1 is made of polyamide-imide system resin, the non-sucking surface 5 may be structured such that a polyurethane system resin sheet member is disposed on the belt back surface member 3. Here, as the polyurethane system resin sheet member, there may be used a rubber member and a foaming member.

Also, in order that the non-sticking portion 4 can reduce its contact area with the belt member 1, there may be employed the following structure.

That is, the non-sucking surface 5 of the non-sticking portion 4 may preferably structured such that it can be contacted with the belt member 1 as a line-shaped contact surface. Owing to this, even when the belt member 1 and belt back surface member 3 are contacted with each other, the contact area thereof can be reduced, thereby being able to reduce an electrostatic sucking force generated between them.

Here, according to a typical embodiment which includes a line-shaped contact surface, a plurality of ribs may be provided in the close portion 3A which respectively project toward the belt member 1. In this case, the rib may preferably have such a curve-shaped section that the contact portion of the rib with the belt member 1 provides the top portion of the rib.

On the other hand, according to a typical embodiment which includes a point-shaped contact surface, in the close portion 3A, as the non-sucking surface 5, there may be formed a granulated surface which is formed according to a granulation working such that it has arithmetic mean roughness Ra of 5 μm or more and a ten point mean roughness Rz of 20 μm or more. When the arithmetic mean roughness Ra of the granulated surface is less than 5 μm or when the ten point mean roughness Rz is less than 20 μm, the average spaced distance between the belt member 1 and granulated surface is also small, thereby raising a fear that the belt member 1 can be stuck to the close portion 3A due to an electrostatic sucking force generated when the belt member 1 rubs against the belt back surface member 3. Also, when the roughness of the granulated surface is increased, the contact area thereof can be reduced but, in order to reduce the damage of the belt member 1 and facilitate the working of the granulated surface, the arithmetic mean roughness Ra may preferably be 20 μm or less. Here, the arithmetic means roughness Ra and ten point mean roughness Rz are based on JIS B 0601-1994.

Generally, the belt member 1 carried on the carry member 2 receives a force in a direction where the belt itself is extended by the carry member 2, and the waving movements of the belt member 1 are easy to increase on the two end sides thereof in the width direction thereof perpendicular to the circulating direction of the belt member 1. Thus, in an image forming apparatus to which a belt feed apparatus according to a second exemplary embodiment of the present embodiment model is applied, the waving movement of the belt member 1 is taken into consideration.

Figure 2A:
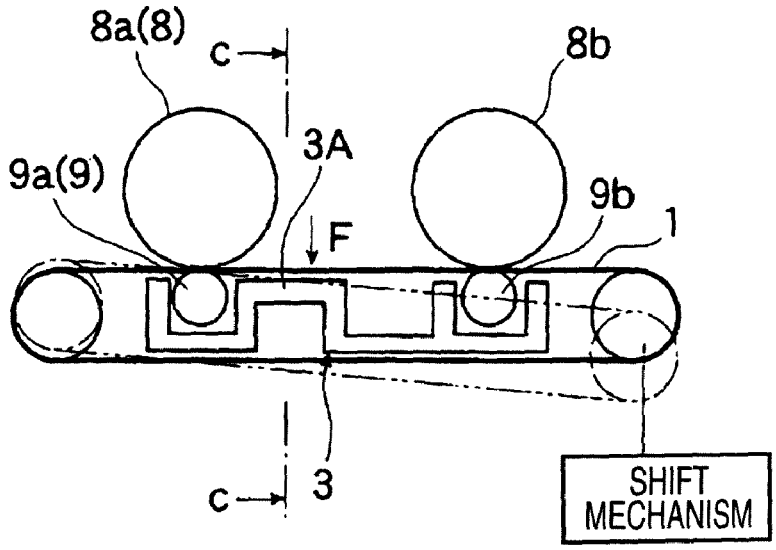
FIG. 2A is an explanatory view of the outline of an image forming apparatus to which a belt feed apparatus according to a second exemplary embodiment of the present embodiment model of the invention is applied.
Figure 2B:
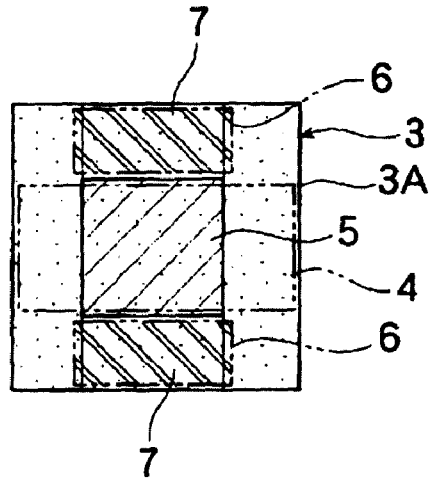
FIG. 2B is a partially enlarged view of a non-sticking portion and an attitude correcting portion respectively formed in a belt back surface member.

That is, as shown in FIGS. 2A and 2B, the image forming apparatus includes an image hold member 8 (8*a*, 8*b*) for holding a toner image and a belt feed apparatus in which an endless belt member 1 is disposed opposed to the image hold member 8 and is allowed to circulate. Specifically, the present belt feed apparatus includes: the endless belt member 1 carried on a plurality of carry members 2 (2*a*, 2*b*) and capable of circulating thereon; a belt back surface member 3 disposed on the back surface side of the belt member 1 and including a close portion 3A, the close portion 3A being disposed such that, when the belt member 1 stands stationary, it is prevented from touching the belt member 1 and also such that, while the belt member 1 is circulating, it exists so close to the belt member 1 as to be contactable with the belt member 1 irregularly; a non-sticking portion 4 including a non-sucking surface 5 formed in a portion of such surface of the close portion 3A of the belt back surface member 3 as opposed to the belt member 1, the non-sucking surface 5 being contactable with the belt member 1 to thereby prevent the belt member 1 against its electrostatic suction to the close portion 3A, and the non-sticking portion 4, owing to the existence of the non-sucking surface 5, capable of preventing the belt member 1 from sticking to the close portion 3A; and, an attitude correcting portion 6 including two sucking surfaces 7 respectively formed in the other portions of the non-sticking portion 4 than the non-sucking surface 5 on the two sides thereof in the width direction perpendicular to the circulating direction of the belt member 1 and easier to suck electrostatically the belt member 1 than the non-sucking surface 5, while the attitude correcting portion 6, owing to existence of the sucking surfaces 7, is capable of electrostatically sucking and moving the width-direction two side portions of the belt member 1 in a direction to move away from the image hold member 8 in a state where the width-direction two side portions are not electrostatically sucked to the sucking surfaces 7, thereby correcting the circulatory feed attitude of the belt member 1. Here, FIG. 2A shows the schematic structure of the image forming apparatus to which the belt feed apparatus according to the second exemplary embodiment is applied, and FIG. 2B is a partially enlarged view of the surface of the close portion 3A shown in FIG. 2A when the close portion 3A is viewed from the arrow mark F direction.

Especially, the belt feed apparatus according to the second exemplary embodiment is suitable for use in an image forming apparatus including a shift mechanism capable of shifting the belt member 1 between a contact position where the belt member 1 is contacted with all of the image hold members (8*a*, 8*b*) and a spaced position where the belt member 1 is contacted with one image hold member 8*a* and is spaced from the other remaining image hold member 8*b*.

Figure 2C:
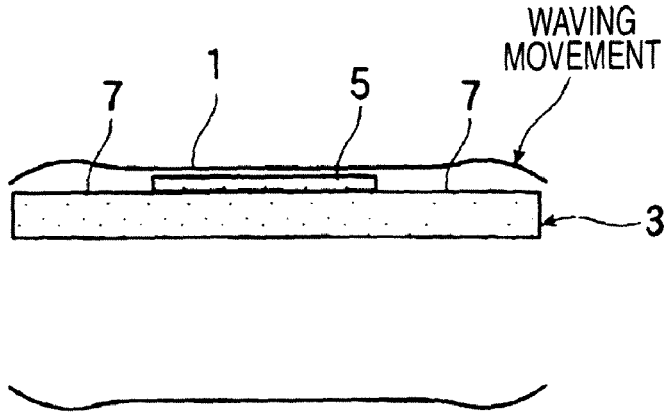
FIG. 2C is an explanatory view of the waving movement of a belt member.

In other words, as shown in FIG. 2C, when the thin belt member 1 is carried on the carry members 2 and is allowed to circulate thereon, in some cases, the width-direction two end portions of the thus carried belt member 1 can be waved. In a structure in which the image hold member 8 is disposed opposed to the belt member 1 and, especially, in a structure in which the image hold member 8 is disposed close to the belt member 1 (for example, in a structure in which the image hold member 8 is disposed close to the transfer portion; or, in a structure in which the image hold member 8 includes a plurality of image hold members 8, with respect to an image holder 8 which is disposed spaced from the belt member 1), such waving motion of the belt member 1 raises a possibility that, while the belt member 1 is circulating, the waved portion of the belt member 1 can be contacted with the image hold member 8. In order to prevent such unnecessary contact of the belt member 1 with the image hold member 8, preferably, the belt member 1 may be prevented from sticking to the close portion 3A of the belt back surface member 3 and the attitude of the belt member 1 may be corrected to thereby prevent the waving motion of the belt member 1.

Specifically, in a portion of the close portion 3A of the belt back surface member 3, there may be provided a non-sticking portion 4 having a non-sucking surface 5 which is prevented from being sucked electrostatically to the belt member 1; and, in the portions of the belt back surface member 3 that exist outside the non-sucking surface 5 of the non-sticking portion 4, there may be provided two attitude correcting portions 6 each including a sucking portion 7 capable of electrostatically sucking and moving the belt member 1 in a state where the belt member 1 is not sucked electrostatically to the close portion 3A. That is, owing to the operations of these two portions, there can be realized an image forming apparatus which not only can prevent the waving motion of the belt member 1 but also can prevent the belt member 1 from sticking to the close portion 3A. Here, FIG. 2C is a section view taken along the c-c line shown in FIG. 2A.

And, as a typical embodiment of the above-structured image forming apparatus, there can be provided an image forming apparatus which, when forming images such as a monochrome image and a color image different in mode from each other, can switch the mode by shifting the belt member 1 using a shift mechanism.

Next, description will be given below in more detail of the influence of the belt member 1 when switching the mode in this manner. Here, it is assumed that, as shown in FIG. 2C, the belt member 1 is waving in the width-direction two end portions thereof, while a non-sucking surface 5 is provided in a portion of the close portion 3A of the belt back surface member 3 and a sucking surface 7 is provided outside the non-sucking surface 5. As shown in FIG. 2A, when, as an image forming apparatus, the belt member 1 is contacted with a plurality of image hold members 8 (8*a*, 8*b*), the belt member 1 is held by the image hold members 8; or, when, as the transfer members 9 (9*a*, 9*b*), there are used roller-shaped members, the belt member 1 is held by and between the image hold members 8 and transfer members 9 disposed opposed to the image hold members 8 from the back surface side of the belt member 1. Therefore, generation of poor images does not provide any special big problem.

However, when there exists an image hold member 8 (in the present embodiment, 8*b*) which is spaced from the belt member 1, depending on the spaced distance thereof, there is a possibility that the waved portion of the belt member 1 can be contacted with the image hold member 8*b*. Especially, when there is employed a system which, when shifting the belt member 1 carried on the carry members 2 (2*a*, 2*b*) using a shift mechanism, the belt member 1 is moved away from the image hold member 8*b* while the belt member 1 remains in contact with one of the image hold member 8*a*, the shift mechanism for shifting the belt member 1 can be itself simplified but it is difficult to secure a large spaced distance, thereby raising a fear that the waved portion of the belt member 1 can be contacted with the image hold member 8*b* to cause a defective image.

On the other hand, according to the present embodiment model, since such portion of the close portion 3A of the belt back surface member 3 as corresponds to the waved portion of the belt member 1 provides the sucking surface 7, the belt back surface 3 and belt member 1 can be electrified due to their mutual friction; and, when the belt member 1 is frictionally electrified once, an electrostatic sucking force is applied to the belt back surface member 3 side of the belt member 1, whereby the waved portion of the belt member 1 is pulled toward the belt back surface member 3. As a result of this, the waving motion of the belt member 1 is controlled and thus the attitude of the belt member 1 is corrected, whereby, even when the spaced distance between the belt member 1 and image holder 8*b* is small, the belt member 1 can be prevented against contact with the image hold member 8*b*.

In this embodiment, the non-sucking surface 5 may only be structured such that the belt member 1 can be prevented from sticking to the close portion 3A as a whole. For example, the non-sucking surface 5 may also be disposed near to the width-direction center of the close portion 3A.

Also, although the sucking surface 7 is not limited to any specific surface, from the viewpoint of simplifying the structure, as the sucking surface 7, preferably, there may be used a flat and smooth surface which is flat and smooth to such a degree that, due to an electrostatic sucking force generated due to friction between the belt member 1 and sucking surface 7, the belt member 1 can be sucked and moved electrostatically in a state where the belt member 1 is not electrostatically sucked to the image hold member 8*b*. Here, in the image forming apparatus to which the belt feed apparatus according to the second exemplary embodiment is applied, the non-sucking surface 5 of the non-sticking portion 4 is similar to the first exemplary embodiment and thus the description thereof is omitted here.

And, in an embodiment in which the belt member 1 is an intermediate transfer member, when there is provided a detect member which is used to detect the density of a toner image on the intermediate transfer member, preferably, the detect member may be disposed such that it corresponds to the area of the non-sucking surface 5. According to this structure, the toner image on the belt member 1 can be detected in the less fluttering portion of the belt member 1, thereby being able to enhance the accuracy of the image detection.

Now, description will be given below in more detail of the invention with reference to the embodiments thereof respectively shown in the accompanying drawings.

Exemplary Embodiment 1

Figure 3:
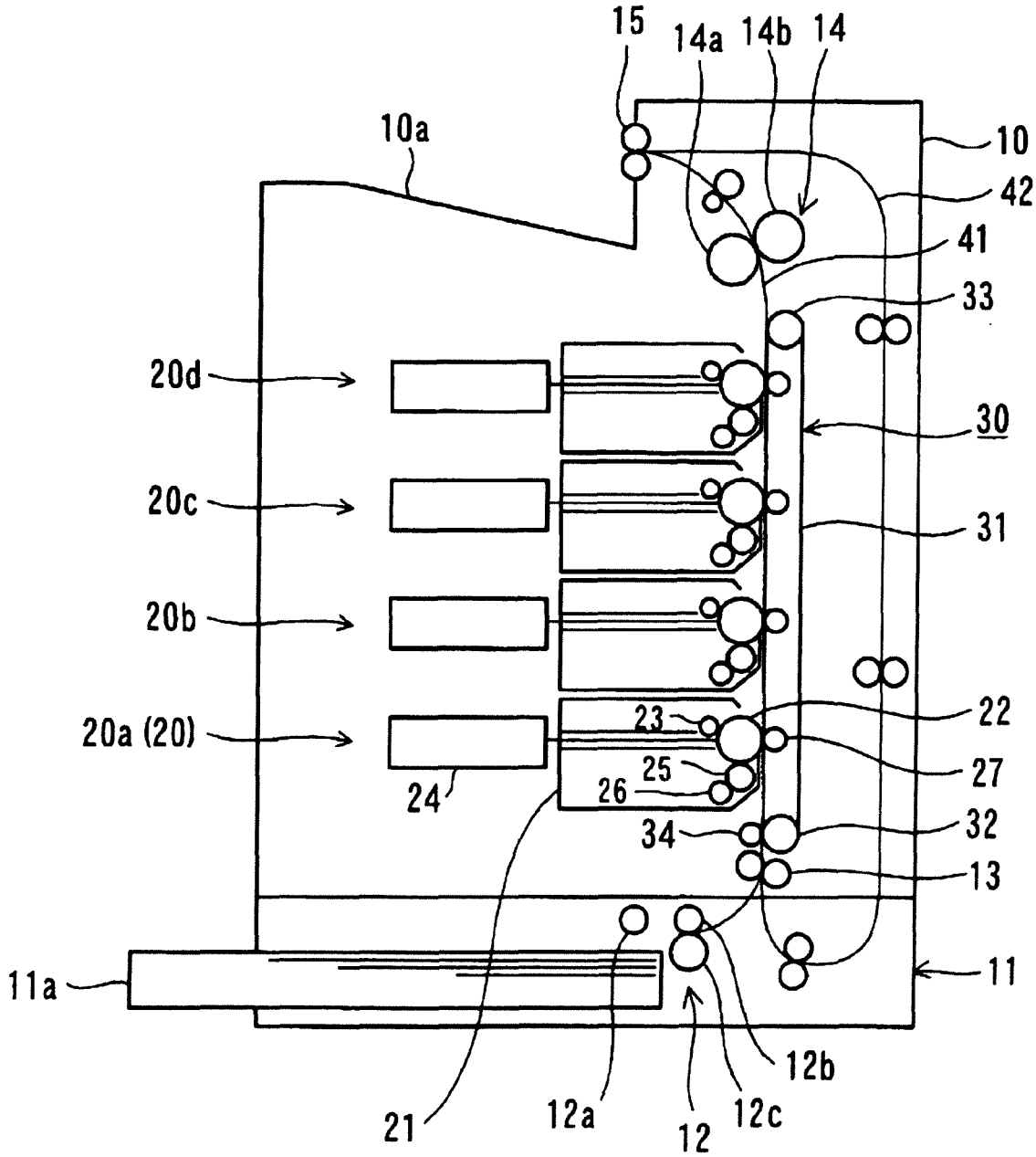
FIG. 3 is an explanatory view of the outline of an image forming apparatus according to an exemplary embodiment 1.

FIG. 3 shows an image forming apparatus according to an exemplary embodiment 1 to which the belt feed apparatus according to the first exemplary embodiment of the present embodiment model. In FIG. 3, the image forming apparatus according to the present embodiment is structured in the following manner: that is, in the lower portion of an apparatus casing 10, there is disposed a recording member supply unit 11 for supplying a recording member in such a manner that the unit 11 can be pulled out; and, upwardly of the recording member supply unit 11, there are arranged image forming engines 20 (20*a*~20*d*) respectively for forming four colors, namely, yellow (Y), magenta (M), cyan (C) and black (K) toner images on the recording member in such a manner that the respective engines 20 extend linearly in the vertical direction.

Also, upwardly of these image forming engines 20, there is disposed a fixing device 14 for fixing toner images formed on the recording member by the image forming engines 20. Further, the apparatus casing 10 includes, in a portion of the upper surface thereof, a recording member storage portion 10*a* into which the recording member fixed by the fixing device 14 is discharged and stored from the apparatus casing 10.

Further, in a position which exists between the recording member supply unit 11 and fixing device 14 within the apparatus casing 10 and is opposed to the four image forming engines 20*a*~20*d*, there is disposed a belt feed apparatus 30 which is structured such that it electrostatically sucks and feeds the recording member and can detach it in a given detach portion.

The image forming engine 20 according to the present embodiment includes a process cartridge 21 capable of forming the respective colors toner images, a laser exposure device 24 for forming an electrostatic latent image on a sensitive member 22 disposed in the rear of the process cartridge 21 for holding therein the toner images formed by the process cartridge 21, and a transfer roller 27 disposed at a position existing within the process cartridge 21 and opposed to the sensitive member 22. Here, at positions which exist within the process cartridge 21 and in the periphery of the sensitive member 22, there are disposed a charging roller 23 for charging the sensitive member 22, a toner supply roller 26 for supplying a toner to developing rollers 25 and 26 which are used to develop electrostatic latent images formed on the sensitive member 22 into visible images, and the like.

Also, the recording member supply unit 11 according to the present embodiment includes a supply cassette 11*a* in which there can be stored recording members that can be supplied therefrom. And, in the vicinity of the recording member feed direction downstream side end portion of the supply cassette 11*a*, there is provided a handling mechanism 12 which is used to handle and send out the recording members one by one from the supply cassette 11*a*. According to the handling mechanism 12, the recording members sent out from the supply cassette 11*a* using a pickup roller 12 are handled through the cooperative operations of the feed roller 12*b* and retard roller 12*c*, and only the top one of the recording members is sent out to the downstream side.

And, on the upstream side of the belt feed apparatus 30, there is disposed a registration roller 13 which registers the positioning of the recording member being fed once and, after then, feeds the thus position-registered recording member to the belt feed apparatus 30 at a given timing.

On the other hand, the fixing device 14 includes, for example, a heating roller 14*a* and a pressurizing roller 14*b* and is structured such that it can carry out the fixation of the toner images sufficiently. Also, on the recording medium feed direction downstream side of the fixing device 14, there is provided a discharge roller 15 which is disposed opposed to the opening of the apparatus casing 10 and is used to discharge the recording members onto the recording member storage portion 10*a*. Here, the discharge roller 15 is to be reversed as the need arises in order to be able to form images on both sides of the recording member.

Also, a recording member feed passage according to the present embodiment includes: a normal feed passage 41 in which the recording member supplied from the supply cassette 11*a* is fed through the registration roller 13, belt feed apparatus 30 and fixing device 30 to the discharge roller 15; and, a reversal feed passage 42 in which the recording member reversed by the discharge roller 15 is fed from the discharge roller 15 through a different passage from the normal feed passage 41 to the registration roller 13.

Also, according to the present embodiment, a portion of the reversal feed passage 42 is formed in the inside of the recording member supply unit 11 as well. Here, in both of the normal feed passage 41 and reversal feed passage 42, there are properly provided feed members (such as a feed roller and a feed guide) which are used to secure the feeding operation of the recording member.

Next, description will be given below of the belt feed apparatus 30 according to the present embodiment.

Figure 4:
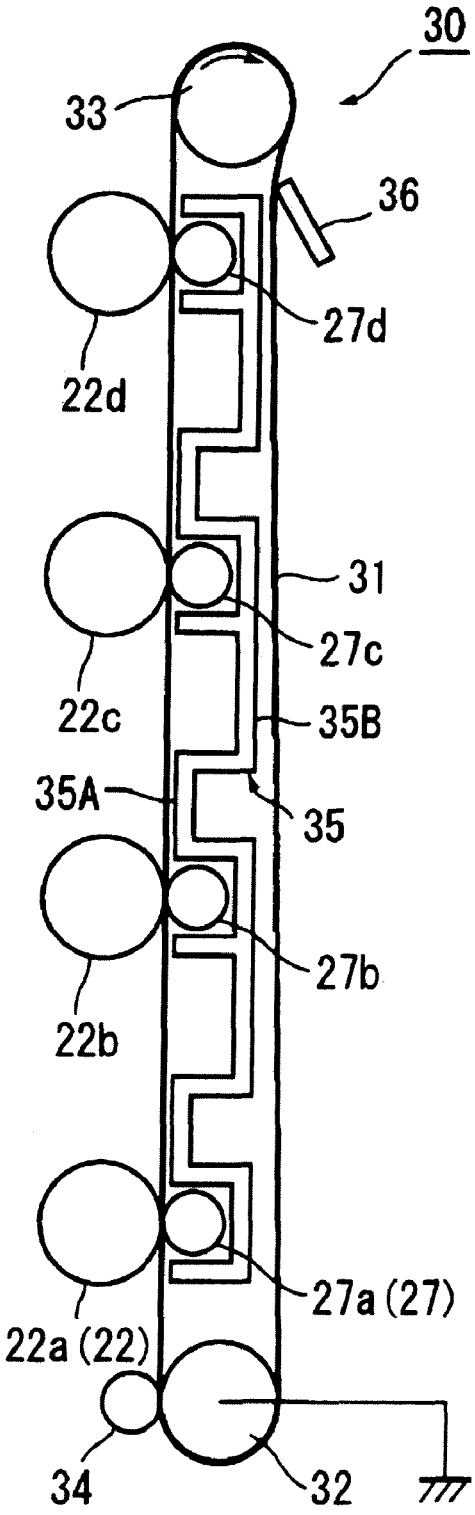
FIG. 4 is an explanatory view of a belt feed apparatus according to the exemplary embodiment 1.

As shown in FIG. 4, the belt feed apparatus 30, which is disposed opposed to the sensitive members 22 (22*a*~22*d*), includes: a feed belt 31 carried on two carry rollers 32 and 33 and capable of circulating thereon in such a manner that it is driven by, for example, the carry roller 33 which is disposed upwardly, that is, disposed on the downstream side in the feed direction of the recording member, the feed belt 31 being made of, for example, polyamide-imide system resin and serving as an endless belt member; a support frame member 35 serving as a synthetic-resin-made belt back surface member provided on the back surface side of the feed belt 31 for supporting, for example, transfer rollers 27 (27*a*~27*d*); a charging device 34 disposed opposed to the carry roller 32 with the feed belt 31 between them for electrostatically sucking the recording member onto the feed belt 31, the carry roller 32 being disposed on the recording member feeding surface of the feed belt 31 on the upstream side in the recording member feed direction; and, a cleaning member 36 which is provided on the recording member non-feeding surface of the feed belt 31 at a position more downstream in the circulating direction of the feed belt 31 than the carry roller 33 so as to press the feed belt 31 toward the support member 35 and is also used to clean the surface of the feed belt 31. Also, according to the present embodiment, the belt feed apparatus 30 further includes the transfer rollers 27.

Here, the charging device 34 is structured such that a given charging bias can be applied from a bias power supply (not shown) into between the charging device 34 and the carry roller 32 grounded as a backup roller to provide a proper electrostatic sucking property for the feed belt 31, thereby allowing the feed belt 31 to start its recording member feeding operation.

On the other hand, the support frame member 35, which is provided on the back surface side of the feed belt 31, is made of a member produced by injection molding a polymer alloy of, for example, polycarbonate resin and ABS resin. And, the support frame member 35 includes, in its downstream side portion adjoining the transfer rollers 27, a surface side projecting surface 35A projecting close to the inner peripheral surface of the recording member feed surface of the feed belt 31 and, in its portion corresponding to the transfer rollers 27 and in its upstream side portion adjoining the transfer rollers 27, a back surface side projecting surface 35B (which corresponds to the close portion) projecting toward the recording member non-feed surface side of the feed belt 31. Here, on the upstream side of the most-upstream transfer roller 27*a* and on the downstream side of the most-downstream side transfer roller 27*d*, in order to reduce the size of the belt feed apparatus 30, there are not provided such projecting surfaces.

Figure 5A:
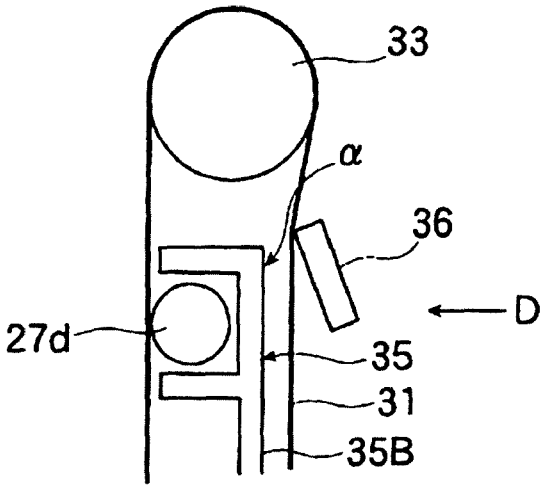
FIG. 5A is a partially enlarged view of the belt feed apparatus.
Figure 5B:
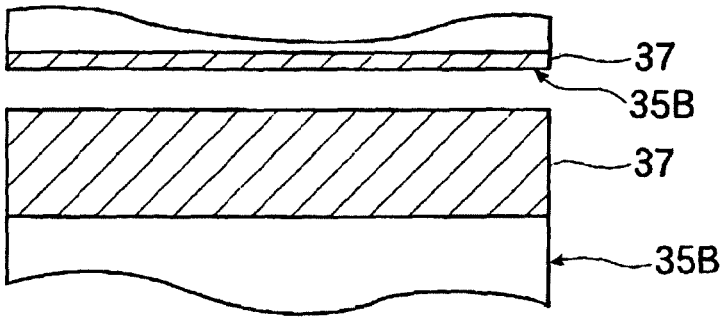
FIGS. 5B to 5D are respectively explanatory views of the specific examples of a non-sticking portion.

And, especially, according to the present embodiment, as shown in FIG. 5A, of the back surface side projecting surface 35B of the support frame member 35, at the close position (in FIG. 5A, an area shown by $\alpha$) of the cleaning member 36, the belt member 31 is made to be closest to the back surface side projecting surface 35B by the cleaning member 36. Owing to this, over the entire feed belt width direction area of the back surface side projecting surface 35B, there is formed a non-sticking portion which can prevent the feed belt 31 from sticking to the support frame member 35 due to an electrostatic sucking force generated between the support frame member 35 and feed belt 31 when the feed belt 31 is contacted with and rubbed against the support frame member 35; and, as the non-sucking surface of the non-sticking portion, there is attached a sheet 37 which is made of polyurethane system resin (see FIG. 5B). Here, the lower portion of FIG. 5B is a front view of the back surface side projecting portion 35B when it is viewed from the arrow mark D direction, while the upper portion of FIG. 5B is a plan view thereof.

In other words, according to the present embodiment, the support frame member 35 corresponds to a belt back surface member; and, in order to reduce the size of the belt feed apparatus 30, the feed belt 31 and a portion of the support frame member 35 are disposed close to each other, and the distance between them is set such that they can be contacted with each other while the feed belt 31 is circulating.

Next, description will be given below of the operations of the support frame member 35 and feed belt 31 in the thus structured belt feed apparatus 30. In the belt feed apparatus 30 shown in FIG. 5A, since the cleaning member 36 presses the feed belt 31 toward the support frame member 35, the feed belt 31 is further easier to come into contact with the support frame member 35. Especially, such phenomenon is easy to occur after the feed belt 31 has been used for a long period of time, or depending on the precision of parts, the assembling precision of the apparatus and the environmental condition thereof. In this case, when the support frame member 35 and feed belt 31 rub against each other and a difference between their mutual charging systems is large, both of them are easy to be charged frictionally, thereby generating a large electrostatic sucking force between them. Especially, as in the present embodiment, when the support frame member 35 is made of synthetic resin, the part precision and mass production performance are both excellent but the influences of the frictional electrification are outstandingly large when compared with the support frame member 35 is made of metal.

And, when such electrostatic sucking force is generated, the feed belt 31 is easy to stick to the support frame member 35. When the feed belt 31 sticks to the support frame member 15 at a position once, the portion of the feed belt 31 existing in the vicinity of such position is also pulled toward the support frame member 35 and thus such sticking tends to increase. As a result of this, the circulatory movement of the feed belt 31 can be made unstable, which can end up stopping the circulatory movement of the feed belt 31.

In view of this, as in the present embodiment, when the sheet 37 is stuck to the portion of the support frame member 35 corresponding to the easy-to-stick portion of the feed belt 31, in this portion, the feed belt 31 is prevented against direct contact with the support frame member 35 and the feed belt 31 can be selectively contacted with the sheet 37. In this case, the amount of frictional electrification generated between the feed belt 31 made of polyamide-imide system resin and the sheet 37 made of polyurethane resin is small (which results from the fact that their mutual electrifying systems are close to each other). This can reduce a force which electrostatically sucks the feed belt 31 toward the sheet 37, thereby being able to prevent the sticking of the feed belt 31. That is, since the sheet 37 stuck portion of the support frame member 35 functions as a non-sucking surface, the above effect can be provided. This can secure the stabilized circulatory motion of the feed belt 31. In other words, according to the present embodiment, the portion where the sheet 37 is stuck can function as the non-sticking portion of the support frame member 35.

Also, according to the present embodiment, as shown in FIG. 5B, the sheet 37 is stuck over the entire area of the support frame member 35 in the width direction thereof perpendicular to the circulating direction of the feed belt 31. However, the sheet 37 may also be stuck selectively to other portion of the support frame member 35 that can be contacted with the feed belt 31. Also, the sheet 37 may also be stuck over the entire area of the back surface side projecting surface 35B. Further, when there is a possibility that the surface side projecting surface 35A can be contacted with the feed belt 31, the sheet 37 may also be stuck to the surface side projecting surface 35A. Here, as the sheet 37, there may be selected a material which has an electrifying system close to the material of the feed belt 31, and the selected material may be stuck to the support frame 35. Also, when the material of the sheet 37 is the same as the material of the support frame member 35, since the frictional electrification need not be taken into account, the support frame member 35 itself may be disposed further closer to the feed belt 31.

In the above embodiment, as a non-sticking portion, there is illustrated an example in which the sheet 37 is stuck to the support frame member 35. However, the non-sticking portion is not limited to this but other means may also be employed. That is, even when the feed belt 31 comes to rub against the support frame member 35, if the contact area thereof is reduced, the amount of frictional electrification itself can be reduced, thereby being able to prevent the sticking of the feed belt 31.

Figure 5C:
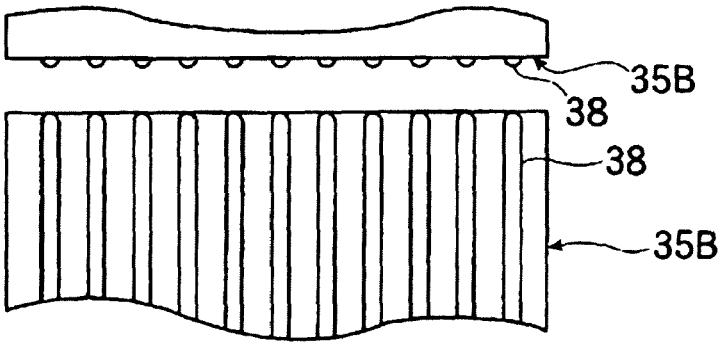
Figure 5D:
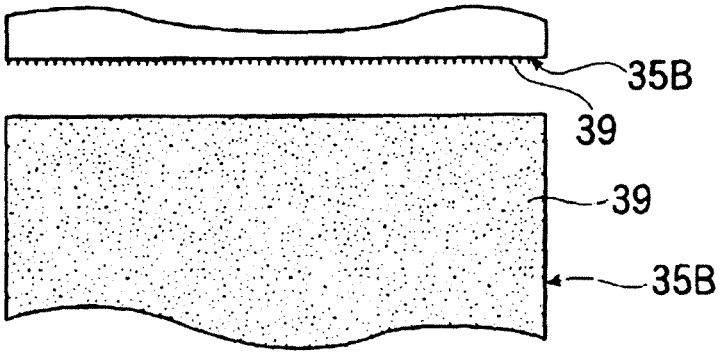

FIGS. 5C and 5D respectively show the examples of the above-mentioned non-sticking portions. Specifically, in an example shown in FIG. 5C, as the non-sucking surface, there are provided a plurality of ribs 38 which are respectively formed on the back surface side projecting surface 35B respectively extending along the circulating direction of the feed belt 31 simultaneously when the support frame member 35 is produced. In this example, the ribs 38 are respectively made of projections which extend in the feed belt circulating direction and each of which has a substantially semicircular-shaped section. In this case, even when the feed belt 31 comes to touch the support frame member 35, the feed belt 31 are actually contacted with the top portions of these ribs 38 and thus the contact surfaces thereof provide linear contact surfaces, so that the contact area thereof itself is very small. Therefore, even when the ribs 38 and feed belt 31 rub against each other, the amount of frictional electrification generated in the mutual rubbing portions can be controlled to a very small amount, which can prevent the feedbelt 31 from sticking to the support frame member 35. Here, the shape of the rib 38 is not limited to this, but, in order to keep the circulatory movement of the feed belt 31 in a good condition, preferably, the rib 38 may have a component which extends along the feed belt circulating direction. Also, according to the present example, there is used a rib which has a height of 1 mm. However, this is not limitative but, normally, there may be used a rib having a height of 0.2 mm or more.

Also, FIG. 5D shows an example in which as a non-sucking surface, a granulated surface 39, which can be produced by granulation working, is provided on the back surface side projecting surface 35B. The granulation working is a working in which, normally, a blasting processing for blasting blast material is enforced on a forming mold or a chemical etching processing is enforced on a forming mold to thereby form an uneven surface, and the uneven surface is used to provide a large number of micro projections. Owing to this, the contact surfaces of the support frame member 35 to be contacted with the feed belt 31 provide dot-like contact surfaces, whereby the contact area thereof is very small. This can reduce the frictional electrification amount between these two members, thereby being able to prevent the feed belt 31 from sticking to the support frame member 35. Here, in the present example, as the granulation surface 39, there is used a granulation surface which has an arithmetic mean roughness Ra of 8 μm. However, this is not limitative but there may also be used a granulation surface which has an arithmetic mean roughness Ra of 5 μm or more or a ten point mean roughness Rz of 20 μm or more.

In other words, according to these examples, the area of the support frame member 35, where the ribs 38 or granulation surface 39 are formed, function as the non-sucking surface of the support frame member 35.

Next, description will be given below of a method for replacing the process cartridge 21 and a method for supplying the recording member to the recording member supply unit 11 in the above-structured image forming apparatus.

Figure 6A:
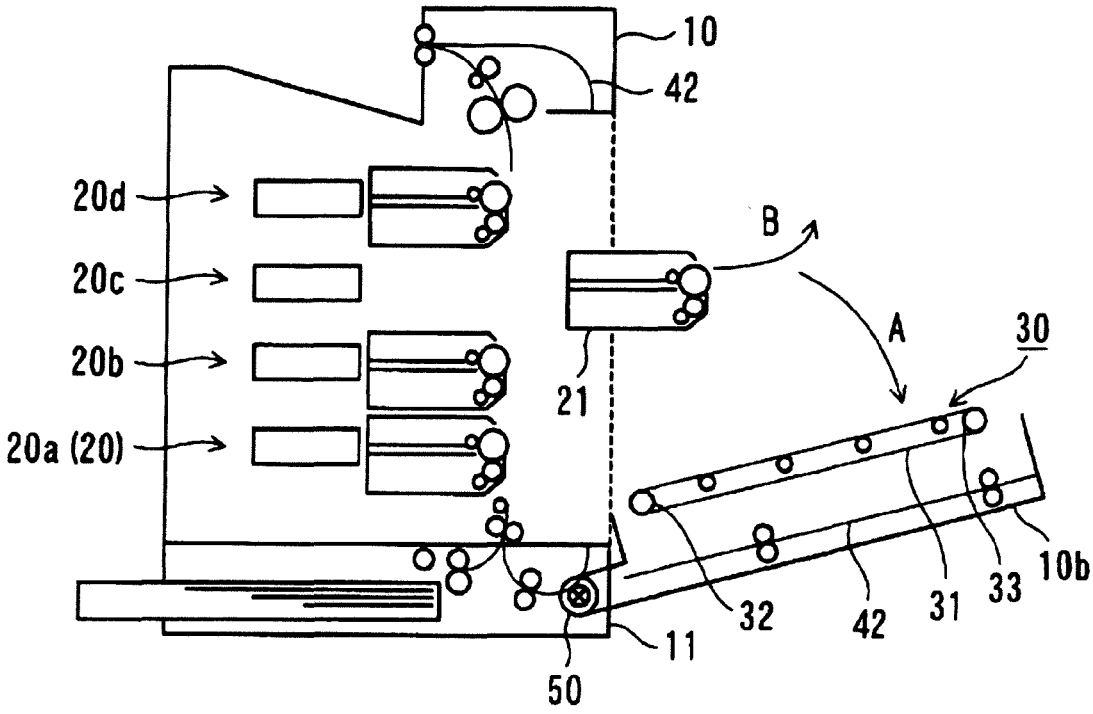
FIG. 6A is an explanatory view of a process cartridge replacing method.

FIG. 6A shows a state in which the main body cover 10*b* provided on the apparatus casing 10 is opened from the apparatus casing 10. On the main body cover 10*b*, there are integrally mounted a portion of a reversal feed passage 42 and the belt feed apparatus 30 respectively by their associated brackets (not shown) or the like and, when the main body cover 10*b* is opened, they are moved with the opening movement of the main body cover 10*b*. Also, the main body cover 10*b* is structured such that it can be opened in the arrow mark "A" direction with a support shaft 50, which is provided on the lower portion of the apparatus casing 10, as a pivot thereof. Owing to this structure, when the main body cover 10*b* is opened, for example, as shown in FIG. 6A, the process cartridge 21 (which, in the present embodiment, corresponds to the process cartridge of the image forming engine 20*c*) can be pulled out easily in the arrow mark "B" direction.

Figure 6B:
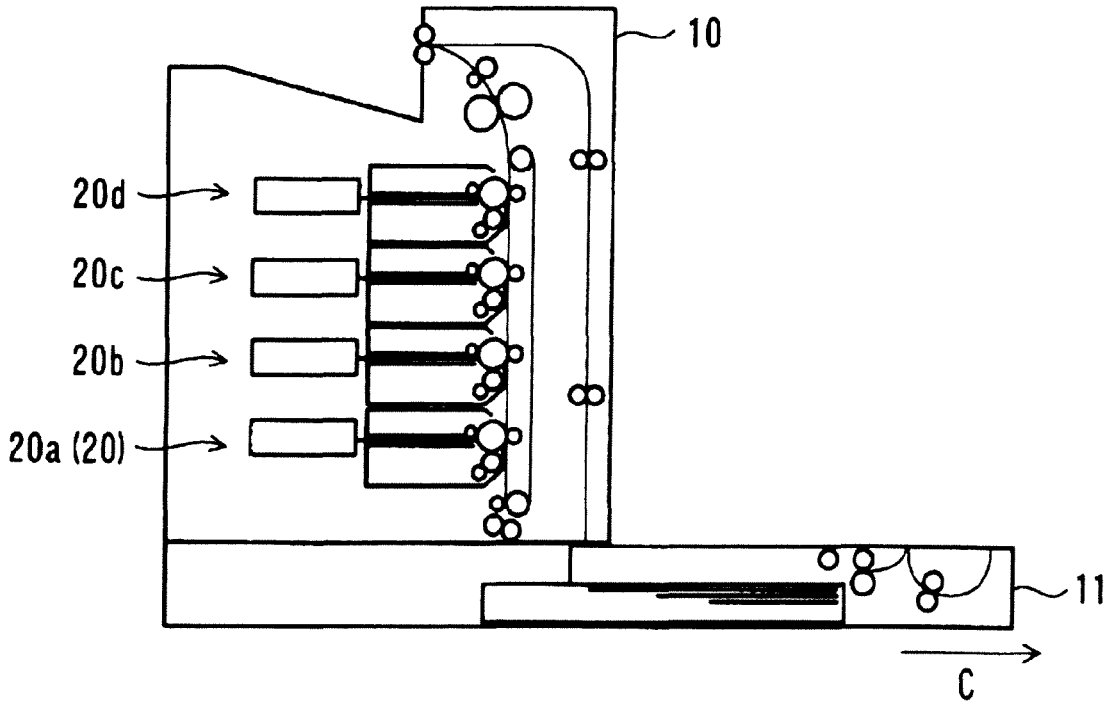
FIG. 6B is an explanatory view of a method for supplying a recording member, respectively in the image forming apparatus according to the exemplary embodiment 1.

Also, FIG. 6B shows a state in which the recording member supply unit 11 provided on the lower portion of the apparatus casing 10 is pulled out from the apparatus casing 10 in the arrow mark "C" direction. Normally, in a state where the recording member supply unit 11 is pulled out from the apparatus casing 10, the recording member is supplied. Owing to this, it is possible to realize an image forming apparatus which is excellent in maintenance and is reduced in size.

Exemplary Embodiment 2

Figure 7:
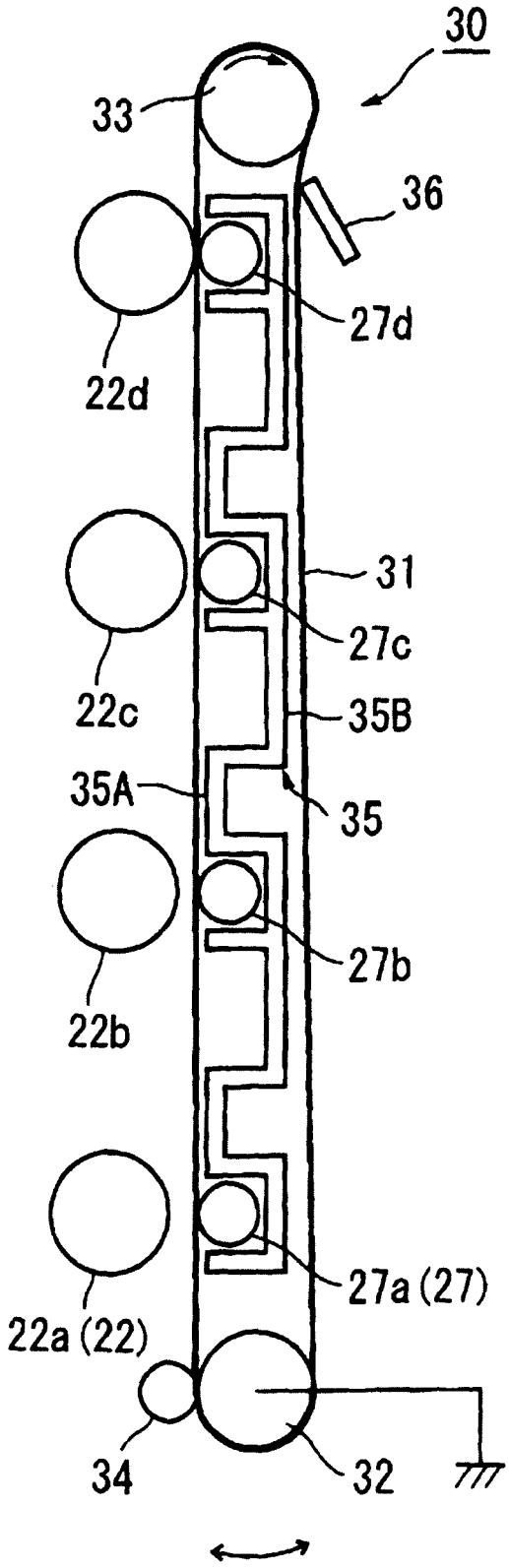
FIG. 7 is an explanatory view of a belt feed apparatus according to an exemplary embodiment 2.

FIG. 7 shows an image forming apparatus according to a second exemplary embodiment to which the belt feed apparatus according to the second exemplary embodiment is applied. The image forming apparatus according to the present embodiment is structured substantially similarly to the exemplary embodiment 1 and the belt feed apparatus 30 is also structured substantially similarly. However, the belt feed apparatus 30 according to the exemplary embodiment 2 is different from the belt feed apparatus 30 according to the exemplary embodiment 1 in that it has a so called retractable structure in which the feed belt 31 is shifted in position between the monochrome image forming time and the color image forming time.

The belt feed apparatus 30 in the color image forming time according to the present embodiment is similar in structure to the exemplary embodiment 1 (see FIG. 4). Thus, description thereof is omitted here and description will be given below of the operation of the belt feed apparatus 30 in the monochrome image forming time. In the monochrome image forming time, as shown in FIG. 7, the feed belt 31 is spaced from three sensitive members 22*a*~22*c*. In other words, the feed belt 31 according to the present embodiment, in the monochrome image forming time, is contacted with only the most-downstream side sensitive member 22*d* and is spaced from the remaining sensitive members 22*a*~22*c*.

Figure 8:
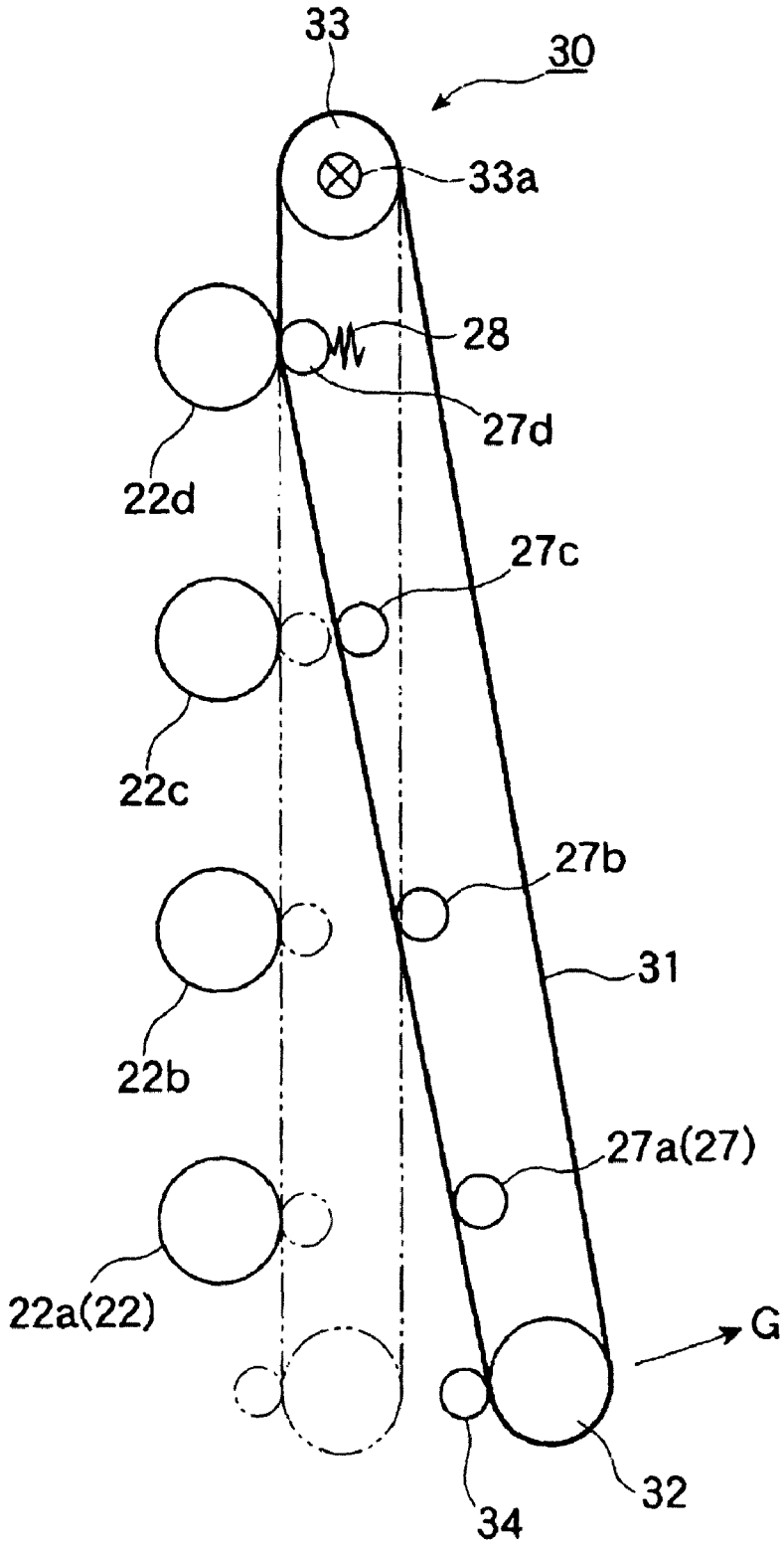
FIG. 8 is a typical view of a shift mechanism employed in the belt feed apparatus according to the exemplary embodiment 2.

According to the present embodiment, a shift mechanism for shifting the feed belt 31 is structured as shown in FIG. 8. Here, FIG. 8 is a typical view of the structure of the shift mechanism of the belt feed apparatus 30 and, for easy understanding, in FIG. 8, a shift amount is expressed in an enlarged manner.

In FIG. 8, the belt feed apparatus 30 according to the present embodiment is structured such that, for example, the upstream side carry roller 32 can be wholly rotated in the arrow mark "G" direction, which is a direction where the roller 32 moves away from the sensitive members 22, about the rotation shaft 33*a* of the most-downstream side (in FIG. 8, the upwardly situated side) carry roller 33. When the carry roller 32 is rotated in this manner, together with this rotation, the respective transfer rollers 27*a*~27*d* are also moved together with a support frame member (not shown); however, since the transfer rollers 27 respectively include energizing members 28 which energize the transfer rollers 27 toward the feed belt 31, to the transfer rollers 27, there are applied forces which press them outwardly with respect to the feed belt 31.

Therefore, the position of the transfer roller 27*d*, which has a small shift amount, is held substantially at the same position thereof before it is spaced. As a result of this, the transfer portions of the three upstream side transfer rollers 27*a*~27*c* are held at positions spaced from their corresponding sensitive members 22 (22*a*~22*c*), whereas the most-downstream side transfer roller 27*d* can be held in a state where it is disposed opposed to the sensitive member 22*d*. This makes it possible to form a monochrome image on the recording member.

In the image forming apparatus of this type, when the feed belt 31 is spaced from the three upstream side sensitive members 22*a*~22*c*, the sensitive member 22*c*, which is situated on the most downstream side of the three sensitive members 22*a*~22*c*, provides the narrowest spacing distance with respect to the feed belt 31. In this case, when the feed belt 31 itself waves in the width-direction two end portions thereof, the waving end portions are easiest to come into contact with the sensitive member 22 having the narrowest spacing distance.

Such contact raises no problem when the feed belt 31 is spaced greatly from the sensitive members 22. However, in order to reduce the size of the apparatus and simplify the shift mechanism, the spacing distance must be controlled to a small distance, which makes it necessary to take measures with respect to the waving movement of the feed belt 31.

Figure 9A:
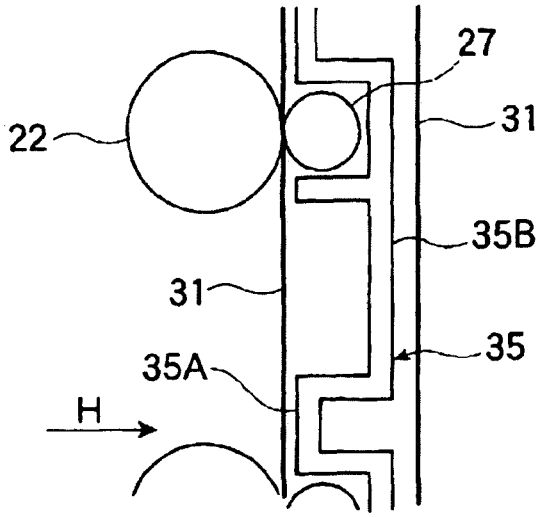
FIG. 9A is a partially enlarged view of the belt feed apparatus according to the exemplary embodiment 2.
Figure 9B:
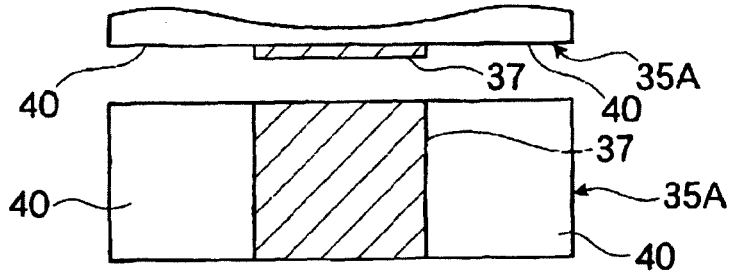
FIGS. 9B to 9D are respectively explanatory views of the specific examples of a non-sticking portion and an attitude correcting portion.

According to the present embodiment, as the measures against the waving movement of the feed belt 31, there is employed the following structure. That is, as shown in FIGS. 9A and 9B, the surface side projecting surface 35A of the support frame member 35 provided on the back surface side of the feed belt 31 is disposed close to the inner peripheral surface of the feed belt 31 with a clearance of approx. 1 mm or less between them. To a portion of the surface side projecting surface 35A (in the present example, a portion which exists near to the width-direction center thereof), there is stuck a sheet 37 which is similar to the embodiment 1; and, the surfaces of other areas of the surface side projecting surface 35A than the sheet sticking area are respectively formed as a flat and smooth surface 40 the surface of which is flat and smooth. In other words, the area with the sheet 37 stuck thereto provides a non-sticking portion having a non-sucking surface thereon, while the two flat and smooth surfaces 40 on both sides of the non-sticking portion respectively provide an attitude correcting portion which has a sucking surface. Here, the lower section of FIG. 9B is a front view of the support frame member 35 when it is viewed from the arrow mark "H" direction, whereas the upper section of FIG. 9B is a plan view of the support frame member 35. Also, the flat and smooth surface 40 is set to have an arithmetic mean roughness Ra of less than 5 μm.

Next, description will be given below of the circulation locus of the feed belt 31 according to the present embodiment.

Figure 10A:
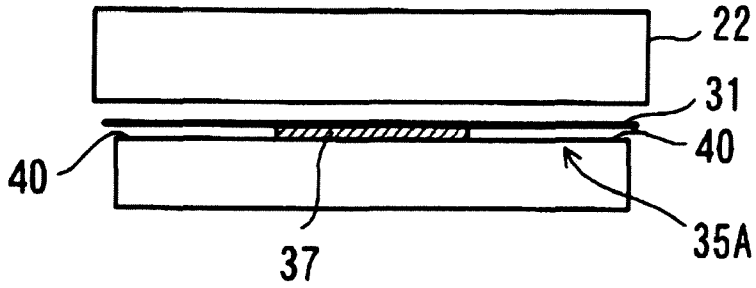

FIG. 10A shows the attitude of the feed belt 31 in the width direction thereof according to the present embodiment. In FIG. 10A, to the surface side projecting surface 35A of the support frame member 35, there is stuck a sheet 37 at a position near to the center of the projecting surface 35A; and, on both sides of the sheet 37, there are formed flat and smooth surfaces 40 respectively.

According to this structure, when the feed belt 31 is contacted with the surface side projecting surface 35A to rub against it, since this portion provides a small frictional electrification amount, in the near-to-center portion of the projecting surface 35A, a force for electrostatically sucking the feed belt 31 toward the surface side projecting surface 35 is small, so that the circulation locus of the feed belt 31 becomes stable. Also, in the flat and smooth surfaces 40, even when it rubs against the feed belt 31 due to the waving movement of the feed belt 31, the amount of frictional electrification generated here remains in the flat and smooth surfaces 40 and thus it acts as a force for electrostatically sucking the feed belt 31 passing here in such a manner that the feed belt 31 is not sucked to the surface side projecting surface 35A electrostatically, thereby electrostatically sucking and moving the feed belt 31 toward the flat and smooth surfaces 40. This can control the waving movement of the feed belt 31 and, even when the spacing distance between the feed belt 31 and sensitive members 22 is narrow, the feed belt 31 can be prevented against contact with the surfaces of the sensitive members 22.

In other words, according to the present embodiment, the sheet 37 stuck portion of the surface side projecting surface 35A near to the feed belt 31 acts as the non-sucking surface to thereby reduce the electrostatic sucking force and thus secure the performance of the non-sticking portion. On the other hand, since the flat and smooth surfaces 40 act as a sucking surface, it acts as the attitude correcting portion to apply a force in a direction to control the waving movement of the feed belt 31. As a result of this, the circulation locus of the feed belt 31 can be stabilized and ill influences due to the waving movement of the feed belt 31 can also be reduced.

Figure 10B:
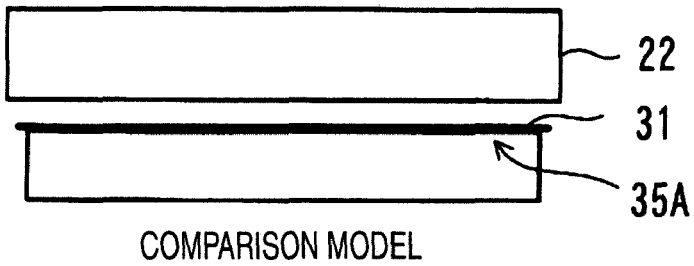
FIGS. 10B and 10C are respectively explanatory views of comparison models; more specifically.
Figure 10C:
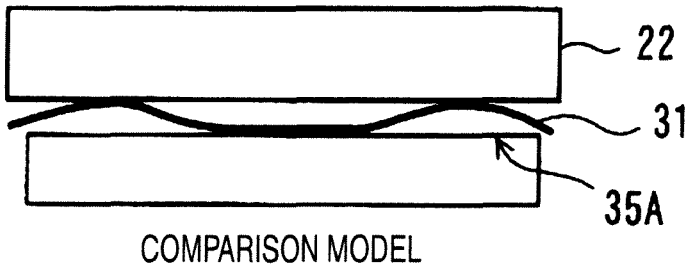

Assuming that, as shown in FIG. 10B, the feed belt 31 does not wave, there is not caused a problem that the feed belt 31 is contacted with the sensitive members 22. However, when the non-sucking surface is not provided on the surface side projecting surface 35A, there is raised a problem that the feed belt 31 can stick to the surface side projecting surface 35A. On the other hand, as shown in FIG. 10C, when the feed belt 31 waves, the waving portion of the feed belt 31 can be contacted with the sensitive members 22. Also, if the non-sucking surface is not provided on the surface side projecting surface 35A, when the feed belt 31 rubs against the surface side projecting surface 35A, the amount of frictional electrification caused by such rubbing action is excessively large, so that, although there is applied a force for restricting the waving movement of the feed belt 31, the circulation locus of the feed belt 31 is impaired.

According to the present embodiment, as shown in FIG. 10A, the sheet 37 is stuck to the near-to-center portion of the surface side projecting surface 35A to provide the non-sucking surface, and both sides of the sheet 37 are formed as the flat and smooth surfaces 40 which function as the sucking surface, thereby being able to satisfy the conflicting actions: that is, not only the circulation locus of the feed belt 31 is not impaired, but also the waving movement of the feed belt 31 can be controlled.

Figure 9C:
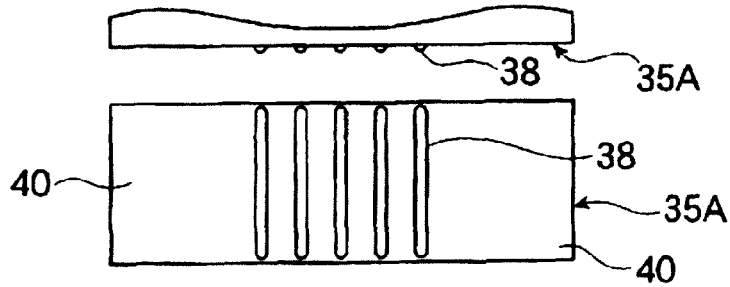
Figure 9D:
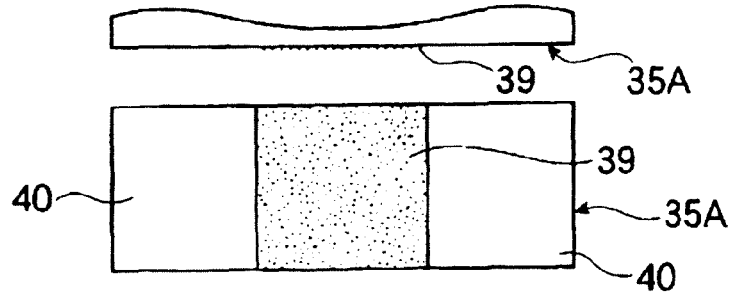

Here, as the non-sucking surface, there is shown an example in which the sheet 37 is stuck to the surface side projecting surface 35A. However, instead of sticking the sheet 37, similarly to the exemplary embodiment 1, there may also be provided such ribs 38 as shown in FIG. 9C. Also, when there is formed such granulated surface 39 as shown in FIG. 9D, there can be provided a similar effect. However, when the ribs 38 or granulated surface 39 are used, of course, both sides of them must be formed as the flat and smooth surfaces 40.

Exemplary Embodiment 3

Figure 11:
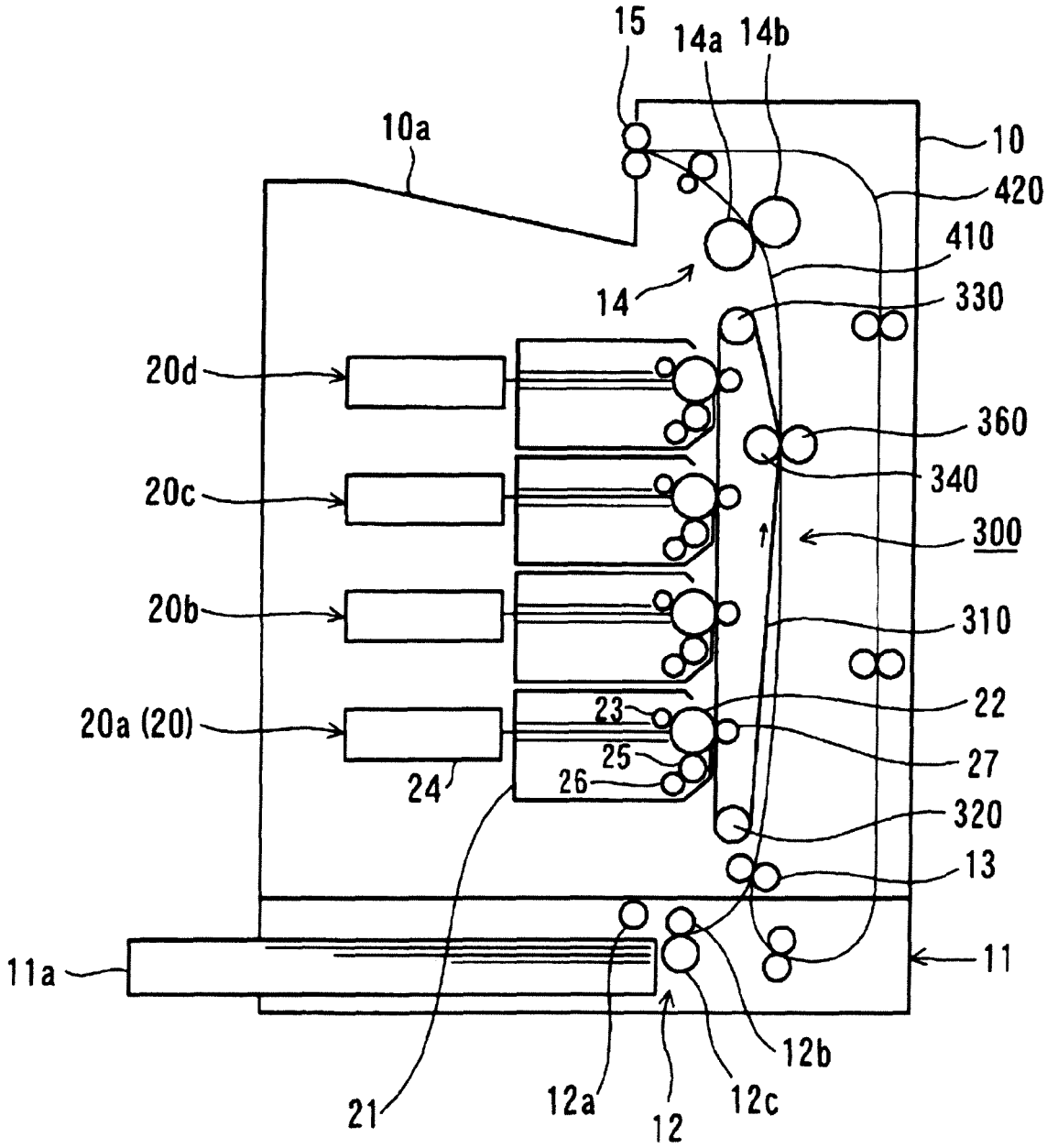
FIG. 11 is an explanatory view of the outline of an image forming apparatus according to an exemplary embodiment 3.

FIG. 11 shows an exemplary embodiment 3 of an image forming apparatus which employs a belt feed apparatus different from those used in the exemplary embodiments 1 and 2.

A belt feed apparatus 300 according to the present embodiment is different from the belt feed apparatus 30 according to the exemplary embodiment 1 (see, for example, FIG. 3) in that, instead of the feed belt, it uses an intermediate transfer belt 310 for holding a toner image temporarily and then feeding it. Here, in the exemplary embodiment 3, the same composing elements thereof as those used in the exemplary embodiment 1 are given the same designations and thus the detailed description thereof is omitted here.

In FIG. 11, an image forming apparatus according to the present embodiment is structured in the following manner: that is, the belt feed apparatus 300 is not formed to suck and feed a recording member but it includes an intermediate transfer belt 310 which is carried on a plurality of (in the present embodiment, three) carry rollers 320, 330, 340 and is allowed to circulate in the arrow mark direction. In this case, at a position that is opposed to the carry roller 340 with the intermediate transfer belt 310 between them, there is provided a secondary transfer roller 360 with the carry roller 340 as its backup roller; and, when a given secondary transfer bias is applied between them, toner images on the intermediate transfer belt 310 can be transferred all at once onto a recording member.

A recording member feed passage according to the present embodiment includes: a normal feed passage 410 in which a recording member sent out from the supply cassette 11*a* moves through the registration roller 13 and secondary transfer portion (a portion where the secondary transfer roller 360 and carry roller 340 are disposed opposed to each other) and reaches the fixing device 14 and discharge roller 15; and, a reversal feed passage 420 in which the recording member reversed by the discharge roller 15 is fed through a different passage from the normal feed passage 410 to the registration roller 13. Here, in these normal feed passage 410 and reversal feed passage 420, there may be provided properly a feed member (such as a feed roller or a feed guide) which is used to secure the feeding performance of the recording member.

Figure 12:
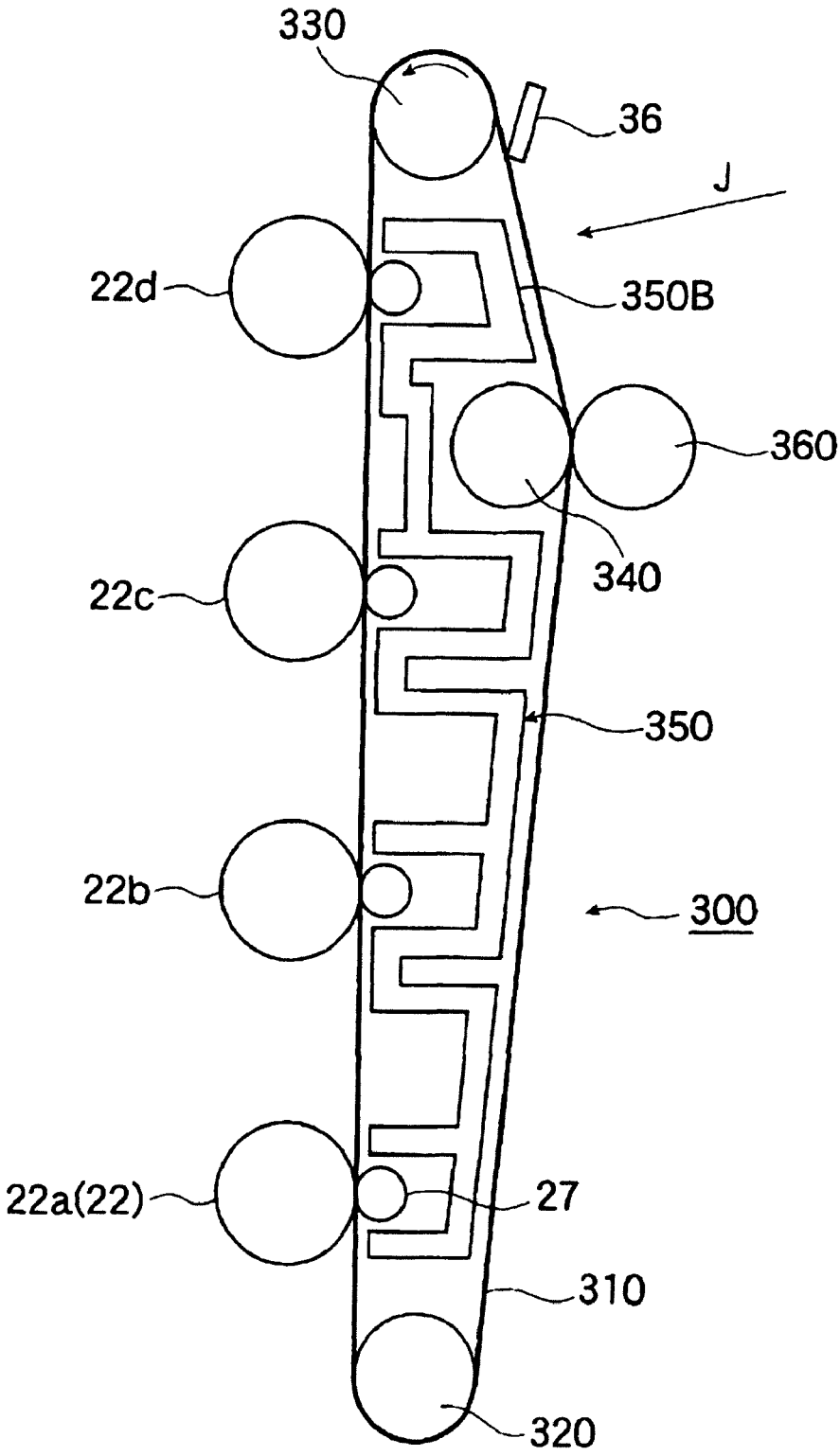
FIG. 12 is an explanatory view of a belt feed apparatus according to the exemplary embodiment 3.

And, a belt feed apparatus 300 according to the present embodiment, as shown in FIG. 12, includes: an intermediate transfer belt 310 which is made of, for example, polyamide-imide system resin and also which can be driven by, for example, a carry roller 330 and is thereby allowed to circulate; a support frame member 350 which is disposed on the back surface side (inner peripheral surface side) of the intermediate transfer belt 310, is made of a polymer alloy composed of, for example, polycarbonate resin and ABS resin, and is used to support transfer rollers 27; and, a cleaning member 36 which is used to clean remaining toners on the intermediate transfer belt 310 on the upstream side of the intermediate transfer belt circulating direction in the vicinity of the carry roller 330.

Figure 13A:
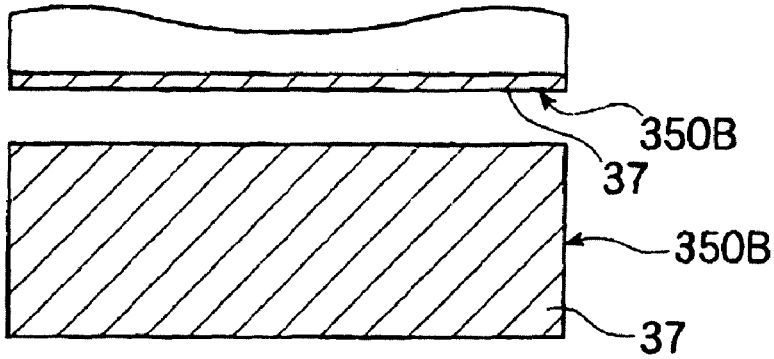
FIGS. 13A to 13C are respectively explanatory views of the specific examples of a non-sticking portion according to the exemplary embodiment 3.

Especially, according to the present embodiment, of the back surface side projecting surface 350B of the support frame member 350, a portion thereof existing near to the cleaning member 36 is modified. The lower section of FIG. 13A is a front view of the support frame member 350 when it is viewed from the arrow mark J direction shown in FIG. 12, while the upper section of FIG. 13A is a plan view thereof. To the entire area of this portion of the support frame member 350, there is stuck a sheet made of polyurethane system resin in the width direction of the intermediate transfer belt 310.

Next, description will be given below mainly of the feeding operation of the recording member to be fed through the normal feed passage 410 according to the image forming apparatus of the present embodiment with reference to FIG. 11. In FIG. 11, recording members, which are sent out from the supply cassette 11*a* by a pickup roller 12*a*, are handled by the cooperative operation of a feed roller 12*b* and a retard roller 12*c*, whereby only the top one of the recording members is sent out toward the downstream side. The thus-sent-out recording member is regulated in position by the registration roller 13 and, after then, it is fed to the downstream side secondary transfer portion at a given timing.

On the other hand, on the side of the image forming engine 20, given toner images are respectively formed on their associated sensitive members 22, and, to the circulation of the intermediate transfer belt 310, the respective color toner images are transferred sequentially from the image forming engine 20*d* onto the intermediate transfer belt 310. On the intermediate transfer belt 310, which has passed through the image forming engine 20*a* situated most-downstream in the intermediate transfer belt circulating direction, there are formed four color multiplexed toner images. These multiplexed toner images are, as they are, transferred to the secondary transfer portion according to the circulation of the intermediate transfer belt 310.

In the secondary transfer portion, the multiplexed toner images on the intermediate transfer belt 310 are transferred all at once onto the recording member sent out from the supply cassette 11*a*. After the transfer of the toner images onto the recording member is finished, the recording member is as it is fed to the fixing device 14, where the transferred toner images are fixed. After then, the recording member is discharged from the discharge roller 15 to the recording member storage portion 10*a*.

In connection with the above operations, description will be given below of the operations of the support frame member 350 and intermediate transfer belt 310 in the belt feed apparatus 300. As shown in FIG. 12, in the back surface side projecting surface 350B of the support frame member 350, especially, since the intermediate transfer belt 310 is pressed toward the support frame member 350 by the cleaning member 36, at a position near to the cleaning member 36, the intermediate transfer belt 310 is easy to come into contact with the support frame member 350. When the support frame member 350 and intermediate transfer belt 310 rub against each other, there is generated frictional electrification between them. When the amount of this frictional electricity becomes excessively large, there is applied an electrostatic sucking force between the intermediate transfer belt 310 and support frame member 350, which impairs the circulation locus of the intermediate transfer belt 310 and finally causes a phenomenon that the intermediate transfer belt 310 sticks to the support frame member 350.

When the circulation locus of the intermediate transfer belt 310 is impaired in this manner, the multiplexing of the toner images on the intermediate transfer belt 310 is ill influenced, which gives rise to image defects such as color shift, or causes the intermediate transfer belt 310 to stick to the support frame member 350, thereby stopping the image forming operation itself.

In order to avoid the above-mentioned inconveniences, according to the present embodiment, as shown in FIG. 13A, the sheet 37 made of polyurethane system resin is stuck onto the corresponding back surface side projecting surface 350B of the support frame member 350. That is, as a non-sucking surface, there is used the sheet 37. The intermediate transfer belt 310 and sheet 37 made of polyurethane system resin are near to each other in the electrification system and thus an amount of frictional electrification between them is small. Therefore, even when the intermediate transfer belt 310 rubs against the support frame member 350, an electrostatic sucking force between the intermediate transfer belt 310 and sheet 37 is small. This can reduce the ill influences on the circulation locus of the intermediate transfer belt 310 and thus can secure the stable circulation of the intermediate transfer belt 310.

According to the present embodiment, as shown in FIG. 13A, the sheet 37 is stuck over the entire area of the support frame member 350 in the width direction thereof perpendicular to the intermediate transfer belt circulating direction. However, the sheet 37 may also be selectively stuck to such portions of the support frame member 350 as can be contacted with the intermediate transfer belt 310. Also, the sheet 37 may also be stuck to the entire area of the back surface side projecting surface 350B.

Figure 13B:
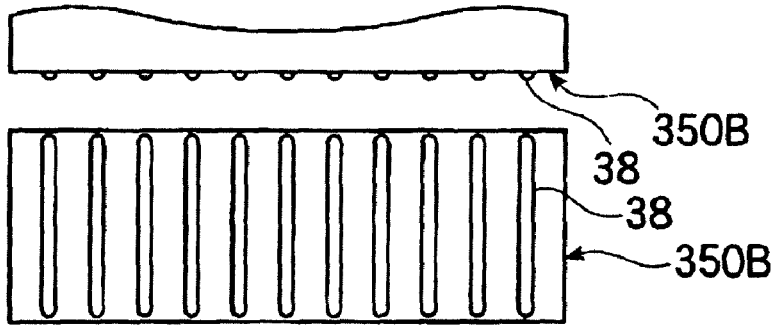

In the above embodiment, there is shown an example of a non-sticking portion which uses the sheet 37 as the non-sucking surface. However, the non-sticking portion is not limited to this but there may also be employed other type of non-sticking portion. That is, as shown in FIG. 13B, as the non-sucking surface of the non-sticking portion, there may also be provided a plurality of ribs 38 on the back surface side projecting surface 350B at the same time when the support frame member 350 is produced. Each rib 38, in the present example, includes a projection, the section of which is substantially semicircular, in a direction along the intermediate transfer belt circulating direction. Owing to this structure, even when the intermediate transfer belt 310 comes into contact with the support frame member 350, since the intermediate transfer belt 310 comes into contact only with the top portion of the rib 38, the contact area between them is very small. Thus, even when the ribs 38 and intermediate transfer belt 310 rub against each other, the amount of frictional electrification generated in these portions is very small, thereby being able to prevent the intermediate transfer belt 310 from sticking to the support frame member 350.

Figure 13C:
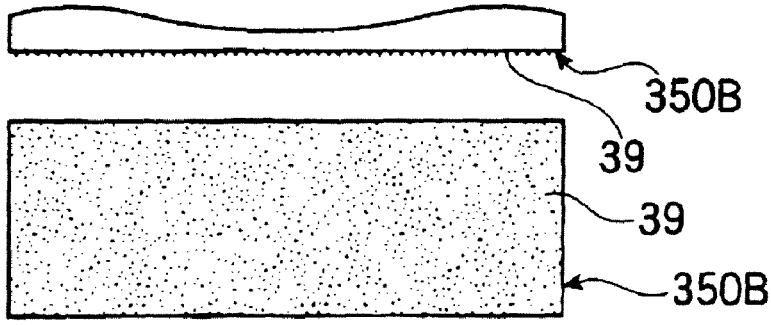

Also, as shown in FIG. 13C, as the non-sucking surface of the non-sticking portion, there may also be formed a granulated surface 39 on the back surface side projecting surface 350B according to a granulation working operation. In this case, there are formed a large number of micro projections on the back surface side projecting surface 350B. Accordingly, when the intermediate transfer belt 310 and support frame member 35 are contacted with each other, the contact area thereof is very small, thereby being able to reduce the amount of frictional electrification generated between them.

Further, according to the present embodiment, not only on the back surface side projecting surface 350B of the support frame member 350, but also on the surface side projecting surface thereof, there may also be formed a similar non-sticking portion.

Exemplary Embodiment 4

Figure 14:
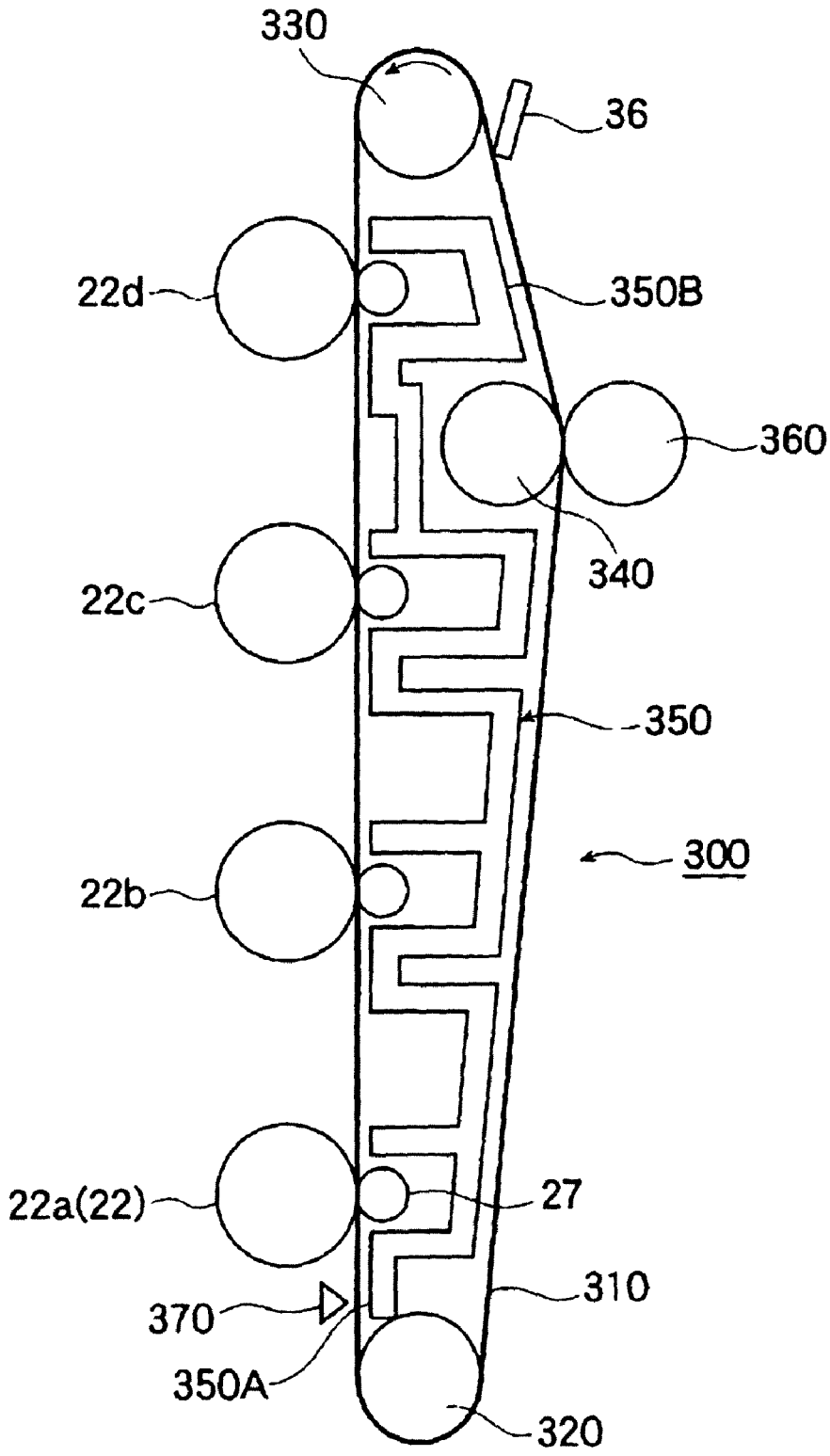
FIG. 14 is an explanatory view of a belt feed apparatus according to an exemplary embodiment 4.

FIG. 14 shows a belt feed apparatus used in an image forming apparatus according to an exemplary embodiment 4 of the invention. In the present embodiment, the image forming apparatus is structured substantially similarly to the image forming apparatus according to the exemplary embodiment 3 but is difference from the image forming apparatus according to the exemplary embodiment 3 in that it includes a detect device for detecting the image densities of toner images on an intermediate transfer belt. Here, the composing elements of the exemplary embodiment 4 similar to those of the exemplary embodiment 3 are given the same designations and thus the detailed description thereof is omitted here.

In FIG. 14, a belt feed apparatus 300 is structured similarly to the belt feed apparatus 300 according to the exemplary embodiment 3 (see FIG. 12) but is different in the following aspect: that is, at a position near to a carry roller 320 and existing upstream in the intermediate transfer belt circulating direction, there is provided a detect device 370 in such a manner that it is opposed to the outer peripheral surface of the intermediate transfer belt 310 and is capable of detecting the image density. Also, on the support frame member 350 side as well, at a position opposed to the detect device 370 with the intermediate transfer belt 310 between them, there is provided a surface side projecting surface 350A; and, the relationship between the structure of the surface side projecting surface 350A and the installation position of the detect device 70 is modified.

Figure 15A:
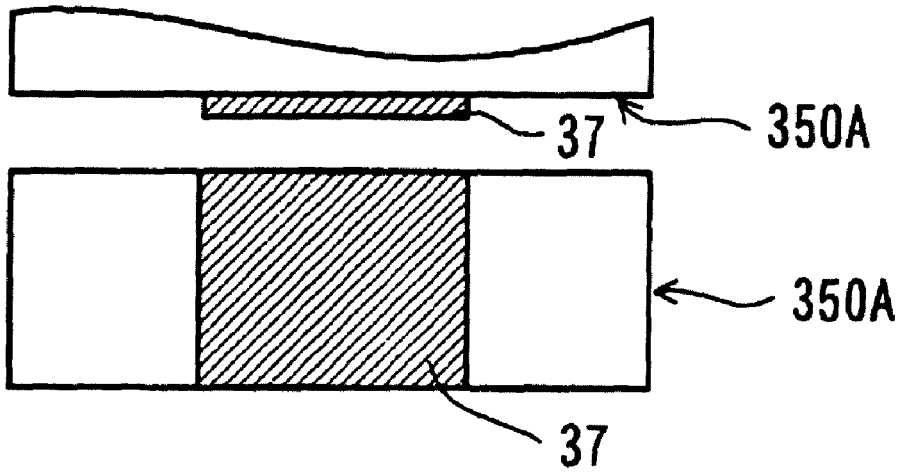
FIG. 15A shows a specific example of a non-sticking portion used in the exemplary embodiment 4.

In the surface side projecting surface 350A according to the present embodiment, as shown in FIG. 15A, in such portion thereof that is near to the center thereof in the intermediate transfer belt circulating direction, there is stuck a sheet 37 functioning as the non-sucking surface of a non-sticking portion.

Figure 15B:
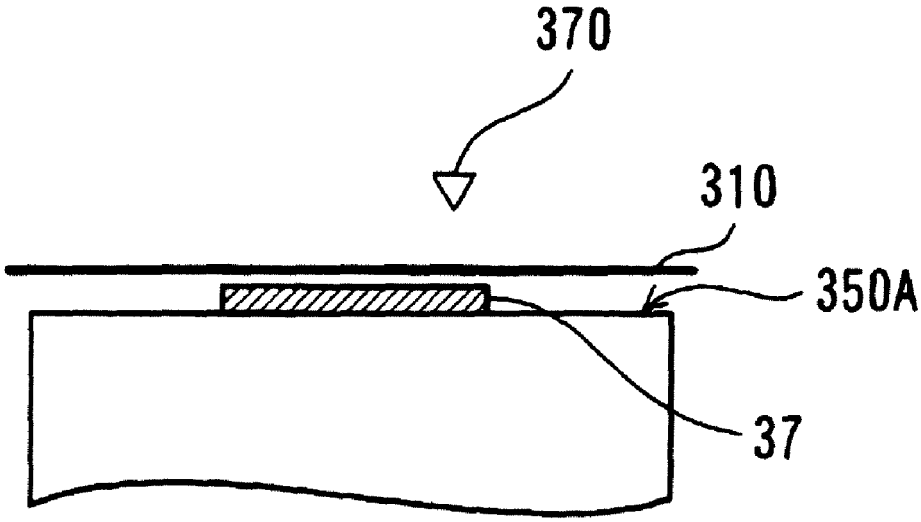
FIG. 15B is an explanatory view of the position relationship between the non-sticking portion and a detect device.

Also, as shown in FIG. 15B, correspondingly to the position where the sheet 37 is stuck, there is provided the detect device 370 which is used to detect the densities of images on the intermediate transfer belt 310. In other words, at the position where the detect device 370 is disposed, the distance between the intermediate transfer belt 310 and support frame member 350 is narrower than distances between them at other positions by an amount equivalent to the sticking of the sheet 37.

When detecting the densities of images on the intermediate transfer belt 310 using the detect device 370, the detect accuracy varies due to the fluttering movement of the intermediate transfer belt 310. In view of this, the installation portion of the detect device 370 must be a portion where the intermediate transfer belt 310 flutters little and also which can provide a space capable of installation of the detect device 370.

According to the present embodiment, since the detect device 370 is disposed so as to correspond to the portion of the surface side projecting surface 350A where the sheet 37 is stuck, even when the intermediate transfer belt 310 happens to flutter, in the sheet 37 stuck portion of the surface side projecting surface 350A, the amount of fluttering of the intermediate transfer belt 310 can be reduced over its peripheral portions. When compared with a structure in which the detect device 370 is disposed at a position not corresponding to the portion where the sheet 37 is stuck, the detect accuracy of the detect device 370 can be enhanced. Here, it goes without saying that, even when the intermediate transfer belt 310 is contacted with the sheet 37, the circulating locus of the intermediate transfer belt 310 can be maintained stably.

According to the present embodiment, there is shown an example in which the sheet 37 is stuck as the non-sucking surface of the non-sticking portion. However, this is not limitative but, similarly to the exemplary embodiment 3, as the non-sucking surface of the non-sticking portion, there may be provided a plurality of ribs on the surface side projecting surface 350A, or there may be provided a granulated surface. This structure can also provide a similar effect to a structure using the sheet 37.

EXAMPLES

Example 1

The present example is conducted on the belt member such as the feed belt and intermediate transfer belt in order to confirm the sheet member suitable for the non-sucking surface of the non-sticking portion; and, specifically, the surface potential of the sheet member is measured after the belt member (polyamide-imide system resin) is made to rub against the surface of the sheet member.

The measurement is carried out under the low temperature low humidity environment (specifically, 10° C. 15% RH) where the frictional electrification amount is large. As the sheet member, there are used a sheet made of polyurethane system resin, a sheet of polyester system resin, and a sheet of polypropylene system sheet. The belt member is put on the sheet member fixed and, while applying a given load to the belt member, the belt member is pulled substantially in the horizontal direction to thereby cause the belt member to rub against the surface of the sheet member.

The measurement is carried out five times and the results of the five measurements are as shown in FIG. 16. Specifically, the polyurethane, polyester and polypropylene sheets all showed large measuring errors; and, polyurethane sheet showed plus and minus values, whereas the remaining sheets showed plus values. Also, in the median values of these materials, the polyurethane sheet showed the smallest surface potential.

In the measurement of the surface potential, it is very difficult to obtain stable measurement values and the measured values vary greatly. Above all, the fact that the polyurethane sheet provides plus and minus values shows that the electrifying system of the polyurethane sheet is near to that of the belt member (polyamide-imide system resin) when compared with the remaining sheets made of different material.

Example 2

The present example is conducted to evaluate the relationship between the surface property of the support frame member and the amount of frictional electrification.

In this example, while applying a given load to the belt member (polyamide-imide system resin, the belt member is pulled substantially in the horizontal direction to thereby rub it against the surface of the granulation worked resin (an alloy of polycarbonate resin and ABS resin). Here, the environmental conditions of this example are set similarly to Example 1.

The test is conducted five times repeatedly and the results of the five measurement tests are as shown in FIG. 17. Here, Ra and Rz respectively designate the arithmetic mean roughness Ra and ten points mean roughness Rz that have been obtained after the measurements are conducted based on JIS B 0601-1994.

FIG. 17 shows that, as the arithmetic mean roughness Ra increases, the median values decrease gradually probably because the contact area of the sheet member with the belt member decreases. The measured values do not always show this tendency. However, this is partly because the measurement of the surface potential itself contains unstable factors to thereby make it difficult to obtain stable measured values. Here, for reference, a polyurethane sheet is also stated in FIG. 17. Since the polyurethane sheet provides plus and minus values as the measured values, it tells that the polyurethane sheet has a property different from the granulation worked sheet member.

Also, using support frame members having the above-mentioned surface properties, in the belt feed apparatus according to the exemplary embodiment 1, a test is conducted to evaluate the circulation performance of the actual feed belt (belt member). The results of this test shows that, as the arithmetic mean roughness Ra decreases, the circulation performance of the feed belt is degraded. Specifically, it is confirmed that, when Ra is 3.5 μm or less, the circulation performance of the feed belt is degraded. Also, this tendency is also confirmed similarly in the ten points mean roughness Rz.

Based on the above-mentioned results, the present inventors et al. have made a further study and, as a result, have confirmed that, when the arithmetic mean roughness Ra is 5 μm or more or when the ten points mean roughness Rz is 20 μm or more, the circulation performance of the feed belt (belt member) is not degraded. This shows that the flat and smooth surface used in the exemplary embodiment 2 may be less than 5 μm. Here, as regards the roughness, in order to prevent the belt member against damage while circulating, it is also found that the upper limit value of the arithmetic mean roughness Ra may preferably be 20 μm.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A belt feed apparatus, comprising:

an endless belt member that is carried on a plurality of carry members and capable of circulatory motion thereon;

a belt back surface member that is disposed on a back surface side of the endless belt member, the belt back surface member including a close portion disposed close to the endless belt member to such a degree that, when the endless belt member stands stationary, the close portion is prevented from touching the endless belt member, and while the endless belt member is circulating, the close portion can be contacted with the endless belt member irregularly; and a non-sticking portion that includes a non-sucking surface contactable with the endless belt member to prevent the endless belt member from being electrostatically sucked to the close portion, the non-sucking surface being provided in an entire portion or part of a surface of the close portion opposed to the endless belt member, and due to the existence of the non-sucking surface, the non-sticking portion being able to prevent the endless belt member from sticking to the close portion, wherein the endless belt member is made of a polyamide-imide system resin, and the non-sucking surface is formed by providing a polyurethane system resin sheet member onto the belt back surface member.

2. The belt feed apparatus according to claim 1, wherein the non-sticking portion is formed integrally with or separately from the close portion of the belt back surface member, and the non-sucking surface is made of a material that provides a small amount of frictional electrification generated due to friction between the endless belt member and the non-sucking surface in a range where the non-sucking surface can prevent the endless belt member from being electrostatically sucked to the close portion.

3. The belt feed apparatus according to claim 1, wherein the non-sucking surface of the non-sticking portion is structured such that the non-sucking surface can be contacted with the endless belt member as a linear-shaped contact surface.

4. The belt feed apparatus according to claim 1, wherein the non-sucking surface of the non-sticking portion is structured such that the non-sucking surface can be contacted with the endless belt member as a dot-shaped contact surface.

5. An image forming apparatus, comprising:

at least one image hold member that holds a toner image; and a belt feed apparatus according to claim 1 disposed opposed to the at least one image hold member.

6. An image forming apparatus, comprising:

at least one image hold member that holds a toner image; and a belt feed apparatus disposed opposed to the at least one image hold member, the belt feed apparatus including:

an endless belt member that is carried on a plurality of carry members and capable of circulatory motion thereon;

a belt back surface member that is disposed on a back surface side of the endless belt member, the belt back surface member including a close portion disposed close to the endless belt member to such a degree that, when the endless belt member stands stationary, the close portion is prevented from touching the endless belt member, and while the endless belt member is circulating, the close portion can be contacted with the endless belt member irregularly; and a non-sticking portion that includes a non-sucking surface contactable with the endless belt member to prevent the endless belt member from being electrostatically sucked to the close portion, the non-sucking surface being provided in a part of a surface of the close portion opposed to the endless belt member, and due to the existence of the non-sucking surface, the non-sticking portion being able to prevent the endless belt member from sticking to the close portion; and an attitude correcting portion that is disposed on both sides of the other areas of the non-sticking portion than the non-sucking surface in a width direction perpendicular to a circulating direction of the endless belt member, the attitude correcting portion including a sucking surface easy to electrostatically suck the endless belt member when compared with the non-sucking surface, and due to the existence of the sucking surface, the attitude correcting portion being able to electrostatically suck and move the width-direction two side portions of the endless belt member in a direction parting away from the at least one image hold member in a state where the width-direction two side portions are not sucked electrostatically to the sucking surface so as to correct a circulatory feed attitude of the endless belt member.

7. The image forming apparatus according to claim 6, wherein the at least one image hold member includes a plurality of image hold members, and the image forming apparatus further comprises:

a shift mechanism that is capable of shifting the endless belt member between a contact position where the endless belt member is contacted with all of the plurality of image hold members and a spaced position where the endless belt member is contacted with one of the plurality of image hold members and is spaced from the remaining image hold members.

8. The image forming apparatus according to claim 6, wherein the non-sucking surface of the non-sticking portion is made of a material that provides a small amount of frictional electrification generated due to friction between the endless belt member and the non-sucking surface in a range where the non-sucking surface can prevent the endless belt member from being electrostatically sucked to the close portion.

9. The image forming apparatus according to claim 6, wherein the non-sucking surface of the non-sticking portion is structured such that the non-sucking surface can be contacted with the endless belt member as a linear-shaped contact surface.

10. The image forming apparatus according to claim 6, wherein the non-sucking surface of the non-sticking portion is structured such that the non-sucking surface can be contacted with the endless belt member as a dot-shaped contact surface.

11. The image forming apparatus according to claim 6, wherein the endless belt member is an intermediate transfer member that holds a toner image temporarily, and the image forming apparatus further comprises:

a detect member that is disposed on a surface side of the endless belt member such that the detect member is opposed to an area of the endless belt member corresponding to the non-sucking surface and is spaced from a surface of the endless belt member, the detect member being capable of detecting a density of the toner image on the endless belt member.

* * * * *